US011657761B2

(12) United States Patent
In et al.

(10) Patent No.: US 11,657,761 B2
(45) Date of Patent: May 23, 2023

(54) DISPLAY PANEL OF AN ORGANIC LIGHT EMITTING DIODE DISPLAY DEVICE, AND ORGANIC LIGHT EMITTING DIODE DISPLAY DEVICE

(71) Applicant: Samsung Display Co., Ltd., Yongin-si (KR)

(72) Inventors: Hai-Jung In, Seoul (KR); Ji-Hyun Ka, Seongnam-si (KR); Won Kyu Kwak, Seongnam-si (KR); Ki Myeong Eom, Suwon-si (KR); Kyonghwan Oh, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 235 days.

(21) Appl. No.: 17/021,935

(22) Filed: Sep. 15, 2020

(65) Prior Publication Data

US 2021/0118368 A1 Apr. 22, 2021

(30) Foreign Application Priority Data

Oct. 18, 2019 (KR) ..... 10-2019-0130121

(51) Int. Cl.
*G09G 3/3258* (2016.01)
*G09G 3/3275* (2016.01)
(Continued)

(52) U.S. Cl.
CPC ..... *G09G 3/3258* (2013.01); *G09G 3/3266* (2013.01); *G09G 3/3275* (2013.01);
(Continued)

(58) Field of Classification Search
CPC .. G09G 3/3258; G09G 3/3275; G09G 3/3266; G09G 3/3233; G09G 2300/0861;
(Continued)

(56) References Cited

U.S. PATENT DOCUMENTS 10,553,663 B2 2/2020 Choi et al.
2005/0270258 A1* 12/2005 Shin ..... G09G 3/3275 345/76

(Continued)

FOREIGN PATENT DOCUMENTS

KR 10-1642995 8/2016
KR 10-2018-0080741 7/2018
KR 10-2019-0034375 4/2019

*Primary Examiner* — William Boddie
*Assistant Examiner* — Saifeldin E Elnafia
(74) *Attorney, Agent, or Firm* — H.C. Park & Associates, PLC

(57) ABSTRACT

A display panel of an organic light emitting diode (OLED) display device having a display region includes a plurality of first pixels located at an upper half of the display region, a plurality of second pixels located at a lower half of the display region, a plurality of first data lines extending in a first direction, and coupled to the plurality of first pixels, a plurality of second data lines extending in the first direction, disposed alternately with the plurality of first data lines along a second direction crossing the first direction, and coupled to the plurality of second pixels, and a demultiplexing circuit configured to selectively couple a plurality of data channels of a data driver of the OLED display device to the plurality of first data lines or the plurality of second data lines.

13 Claims, 16 Drawing Sheets

(51) Int. Cl.
*G09G 3/3266* (2016.01)
*G09G 3/3233* (2016.01)

(52) U.S. Cl.
CPC ... *G09G 3/3233* (2013.01); *G09G 2300/0426* (2013.01); *G09G 2300/0809* (2013.01); *G09G 2300/0819* (2013.01); *G09G 2300/0842* (2013.01); *G09G 2300/0861* (2013.01); *G09G 2310/0297* (2013.01); *G09G 2320/0233* (2013.01); *G09G 2320/0238* (2013.01); *G09G 2320/0257* (2013.01); *G09G 2320/103* (2013.01); *G09G 2330/02* (2013.01)

(58) Field of Classification Search
CPC ..... G09G 2300/0809; G09G 2320/103; G09G 2300/0426; G09G 2300/0819; G09G 2320/0257; G09G 2320/0233; G09G 2300/0842; G09G 2310/0297; G09G 2320/0238; G09G 2330/02
See application file for complete search history.

(56) References Cited

U.S. PATENT DOCUMENTS

2006/0071884 A1* 4/2006 Kim ..... G09G 3/3233 345/76
2011/0050741 A1* 3/2011 Jeong ..... G09G 3/3291 345/82
2012/0313903 A1* 12/2012 Pyon ..... G09G 3/3233 345/82
2013/0335309 A1* 12/2013 Kerofsky ..... G09G 3/3406 345/102
2016/0014402 A1* 1/2016 Lee ..... H04N 13/398 348/51
2017/0154598 A1* 6/2017 Park ..... G09G 3/3688
2018/0158410 A1* 6/2018 Jeon ..... H01L 27/3262
2019/0096330 A1* 3/2019 Kim ..... G09G 3/3233

* cited by examiner

DISPLAY PANEL OF AN ORGANIC LIGHT EMITTING DIODE DISPLAY DEVICE, AND ORGANIC LIGHT EMITTING DIODE DISPLAY DEVICE

CROSS-REFERENCE TO RELATED APPLICATION

This application claims priority from and the benefit of Korean Patent Application No. 10-2019-0130121, filed on Oct. 18, 2019, which is hereby incorporated by reference for all purposes as if fully set forth herein.

BACKGROUND

Field

Exemplary embodiments of the invention relate generally to a display device, and more specifically to a display panel of an organic light emitting diode display device, and the organic light emitting diode display device.

Discussion of the Background

Respective pixels of an organic light emitting diode (OLED) display device store data signals applied through data lines, generate driving currents based on the stored data signals, and emit light based on the driving currents. However, driving transistors of the respective pixels may have different voltage-current characteristics due to driving hysteresis based on previous and current data signals. Accordingly, the respective pixels may not emit with desired luminance, and luminance uniformity of the OLED display device may be degraded.

To improve the luminance uniformity, a biasing operation that initializes the voltage-current characteristics of the driving transistors by applying a bias (e.g., an on-bias) to the driving transistors may be performed. For example, the biasing operation for the driving transistors of the pixels may be performed while a data writing operation (or a data programming operation) that the writes (or programs) the data signals to the respective pixels is performed. However, a frequency of the data writing operation may be limited according to a resolution or the number of pixel rows of the OLED display device, and thus a frequency of the biasing operation also may be limited.

The above information disclosed in this Background section is only for understanding of the background of the inventive concepts, and, therefore, it may contain information that does not constitute prior art.

SUMMARY

Devices and methods according to exemplary embodiments provide a display panel where a biasing operation is performed at a frequency higher than a frequency of a data writing operation without a ghost defect.

Some devices constructed according to exemplary embodiments provide an organic light emitting diode (OLED) display device that performs a biasing operation at a frequency higher than a frequency of a data writing operation without a ghost defect.

Additional features of the inventive concepts will be set forth in the description which follows, and in part will be apparent from the description, or may be learned by practice of the inventive concepts.

According to one or more exemplary embodiments of the invention, there is provided a display panel of an organic light emitting diode (OLED) display device having a display region. The display panel includes a plurality of first pixels located at an upper half of the display region, a plurality of second pixels located at a lower half of the display region, a plurality of first data lines extending in a first direction, and coupled to the plurality of first pixels, a plurality of second data lines extending in the first direction, disposed alternately with the plurality of first data lines along a second direction crossing the first direction, and coupled to the plurality of second pixels, and a demultiplexing circuit configured to selectively couple a plurality of data channels of a data driver of the OLED display device to the plurality of first data lines or the plurality of second data lines.

In exemplary embodiments, the demultiplexing circuit may respectively couple the plurality of data channels to the plurality of first data lines during a first half of a frame period, and may respectively couple the plurality of data channels to the plurality of second data lines during a second half of the frame period.

In exemplary embodiments, the demultiplexing circuit may couple the plurality of second data lines to a bias voltage line during the first half of the frame period, and may couple the plurality of first data lines to the bias voltage line during the second half of the frame period.

In exemplary embodiments, a bias voltage applied to the bias voltage line may be higher than a highest data voltage.

In exemplary embodiments, a bias voltage applied to the bias voltage line may be changed in each frame period.

In exemplary embodiments, a data writing operation for the display panel may be performed at a first frequency, and a biasing operation for the display panel may be performed at a second frequency higher than the first frequency.

In exemplary embodiments, a time length of a frame period may be determined corresponding to the first frequency, the data writing operation for the display panel may be performed once per the frame period, and the biasing operation for the display panel may be performed twice per the frame period.

In exemplary embodiments, the plurality of first pixels may be located in N/2 rows from a first row to an (N/2)-th row, where N is an integer greater than 1, and the plurality of first pixels may be located in N/2 rows from an (N/2+1)-th row to an N-th row. During a first half of a frame period, the biasing operation and the data writing operation for the plurality of first pixels may be sequentially performed from the first row to the (N/2)-th row, and the biasing operation for the plurality of second pixels may be sequentially performed from the (N/2+1)-th row to the N-th row. During a second half of the frame period, the biasing operation for the plurality of first pixels may be sequentially performed from the first row to the (N/2)-th row, and the biasing operation and the data writing operation for the plurality of second pixels may be sequentially performed from the (N/2+1)-th row to the N-th row.

In exemplary embodiments, the demultiplexing circuit may include a plurality of first switches configured to respectively couple the plurality of data channels to the plurality of first data lines in response to an upper select signal, a plurality of second switches configured to respectively couple the plurality of data channels to the plurality of second data lines in response to a lower select signal, a plurality of third switches configured to couple the plurality of first data lines to a bias voltage line in response to the lower select signal, and a plurality of fourth switches configured to couple the plurality of second data lines to the bias voltage line in response to the upper select signal.

In exemplary embodiments, during a first half of a frame period, the upper select signal may have an on level, and the lower select signal may have an off level. During a second half of the frame period, the upper select signal may have the off level, and the lower select signal may have the on level.

In exemplary embodiments, each of the plurality of first and second pixels may include a capacitor including a first electrode coupled to a line of a first power supply voltage, and a second electrode, a first transistor including a gate electrode coupled to the second electrode of the capacitor, a second transistor including a gate for receiving a gate writing signal, a first terminal coupled to a corresponding one of the plurality of first and second data lines, and a second terminal coupled to the first terminal of the first transistor, a third transistor including a gate for receiving a gate compensation signal, a first terminal coupled to the second terminal of the first transistor, and a second terminal coupled to the gate of the first transistor, a fourth transistor including a gate for receiving a gate initialization signal, a first terminal coupled to the second electrode of the capacitor and the gate of the first transistor, and a second terminal coupled to a line of a first initialization voltage, a fifth transistor including a gate for receiving an emission signal, a first terminal coupled to the line of the first power supply voltage, and a second terminal coupled to the first terminal of the first transistor, a sixth transistor including a gate for receiving the emission signal, a first terminal coupled to the second terminal of the first transistor, and a second terminal coupled to an anode of an organic light emitting diode, a seventh transistor including a gate for receiving a gate bypass signal, a first terminal coupled to a line of a second initialization voltage, and a second terminal coupled to the anode of the organic light emitting diode, and the organic light emitting diode including the anode coupled to the second terminal of the sixth transistor, and a cathode coupled to a line of a second power supply voltage.

In exemplary embodiments, a biasing operation and a data writing operation for each of the plurality of first and second pixels may be performed in response to the gate initialization signal, the gate writing signal, the gate compensation signal and the gate bypass signal while the emission signal has an off level, and the biasing operation for each of the plurality of first and second pixels may be performed in response to the gate writing signal and the gate bypass signal while the emission signal has the off level.

In exemplary embodiments, the first, second, fifth and sixth transistors may be implemented with PMOS transistors, and the third, fourth and seventh transistors may be implemented with NMOS transistors. The gate writing signal and the emission signal applied to the second, fifth and sixth transistors may be active low signals that have a low level as an on level, and the gate compensation signal, the gate initialization signal and the gate bypass signal applied to the third, fourth and seventh transistors may be active high signals that have a high level as the on level. The emission signal may be used as the gate bypass signal.

In exemplary embodiments, the first, second, fifth, sixth and seventh transistors may be implemented with positive channel metal oxide semiconductor (PMOS) transistors, and the third and fourth transistors may be implemented with negative channel metal oxide semiconductor (NMOS) transistors. The gate writing signal, the emission signal and the gate bypass signal applied to the second, fifth, sixth and seventh transistors may be active low signals that have a low level as an on level, and the gate compensation signal and the gate initialization signal applied to the third and fourth transistors may be active high signals that have a high level as the on level. One of the gate writing signal for a previous row, the gate writing signal for a current row, and the gate writing signal for a next row may be used as the gate bypass signal for the current row.

According to one or more exemplary embodiments of the invention, there is provided a display panel of an organic light emitting diode (OLED) display device having a display region. The display panel includes a plurality of pixels located in N rows and M columns, where N is an integer greater than 1, and M is an integer greater than 1, M first data lines extending in a first direction, M second data lines extending in the first direction, and disposed alternately with the first data lines along a second direction crossing the first direction, and a demultiplexing circuit configured to selectively couple a plurality of data channels of a data driver of the OLED display device to the first data lines or the second data lines, and couple data lines not coupled to the plurality of data channels from among the first data lines and the second data lines to a bias voltage line. The plurality of pixels in a K-th row of the N rows and the plurality of pixels in an (N/2+K)-th row of the N rows are coupled to different data lines from among the first data lines and the second data lines, where K is an integer greater than 0 and less than N/2.

In exemplary embodiments, the plurality of pixels in odd-numbered rows from among first through (N/2)-th rows may be coupled to the first data lines, the plurality of pixels in even-numbered rows from among the first through (N/2)-th rows may be coupled to the second data lines, the plurality of pixels in odd-numbered rows from among (N/2+1)-th through N-th rows may be coupled to the second data lines, and the plurality of pixels in even-numbered rows from among the (N/2+1)-th through N-th rows may be coupled to the first data lines.

In exemplary embodiments, the plurality of pixels in first through (N/2)-th rows may be coupled to the first data lines or the second data lines alternately per L rows, where L is an integer greater than 1 and less than N/2, and the plurality of pixels in (N/2+1)-th through N-th rows may be coupled to the second data lines or the first data lines alternately per L rows.

According to one or more exemplary embodiments of the invention, there is provided an organic light emitting diode (OLED) display device including a display panel having a display region, and including a plurality of first pixels located at an upper half of the display region, and a plurality of second pixels located at a lower half of the display region, a data driver including a plurality of data channels for outputting a data signal, a gate driver configured to provide a gate initialization signal, a gate writing signal and a gate compensation signal to the plurality of first and second pixels, and a controller configured to control the data driver and the gate driver. The display panel further includes a plurality of first data lines extending in a first direction, and coupled to the plurality of first pixels, a plurality of second data lines extending in the first direction, disposed alternately with the plurality of first data lines along a second direction crossing the first direction, and coupled to the plurality of second pixels, and a demultiplexing circuit configured to selectively couple the plurality of data channels to the plurality of first data lines or the plurality of second data lines.

In exemplary embodiments, the controller may include a still image detector configured to determine whether input image data represents a still image. The controller may decide a driving frequency for the display panel as a first frequency when the input image data does not represent the still image, and may decide the driving frequency for the display panel as a third frequency lower than the first frequency when the input image data represents the still image.

In exemplary embodiments, when the input image data represents the still image, the gate driver may provide the gate initialization signal and the gate compensation signal to the plurality of first and second pixels at the third frequency such that a data writing operation for the display panel is performed at the third frequency, and may provide the gate writing signal to the plurality of first and second pixels at a second frequency higher than the first frequency such that a biasing operation for the display panel is performed at the second frequency.

As described above, in a display panel of an OLED display device and the OLED display device according to exemplary embodiments of the inventive concepts, a plurality of first pixels may be located in an upper half of an display region, a plurality of second pixels may be located in a lower half of the display region, a plurality of first data lines may be coupled to the plurality of first pixels, a plurality of second data lines may be coupled to the plurality of second pixels, and a demultiplexing circuit may selectively couple a plurality of data channels to the plurality of first data lines or the plurality of second data lines. Thus, while a biasing operation and a data writing operation for the plurality of first (or second) pixels are performed by applying data signals through the plurality of first (or second) data lines, a biasing operation for the plurality of second (or first) pixels may be performed by applying a bias voltage through the plurality of second (or first) data lines. Accordingly, the biasing operation may be performed at a frequency higher than a frequency of the data writing operation without a ghost defect.

Further, in a display panel of an OLED display device and the OLED display device according to exemplary embodiments of the inventive concepts, a K-th row of pixels and an (N/2+K)-th row of pixels may be coupled to different first and second data lines, where N is an integer greater than 1, and K is an integer greater than 0 and less than or equal to N/2, and a demultiplexing circuit may selectively couple a plurality of data channels to the first data lines or the second data lines, and may couple data lines not coupled to the plurality of data channels from among the first data lines and the second data lines to a bias voltage line. Thus, a biasing operation for the (N/2+K)-th row of pixels may be performed while a biasing operation and a data writing operation for the K-th row of pixels are performed, and the biasing operation for the K-th row of pixels may be performed while the biasing operation and the data writing operation for the (N/2+K)-th row of pixels are performed. Accordingly, the biasing operation may be performed at a frequency higher than a frequency of the data writing operation without a ghost defect.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
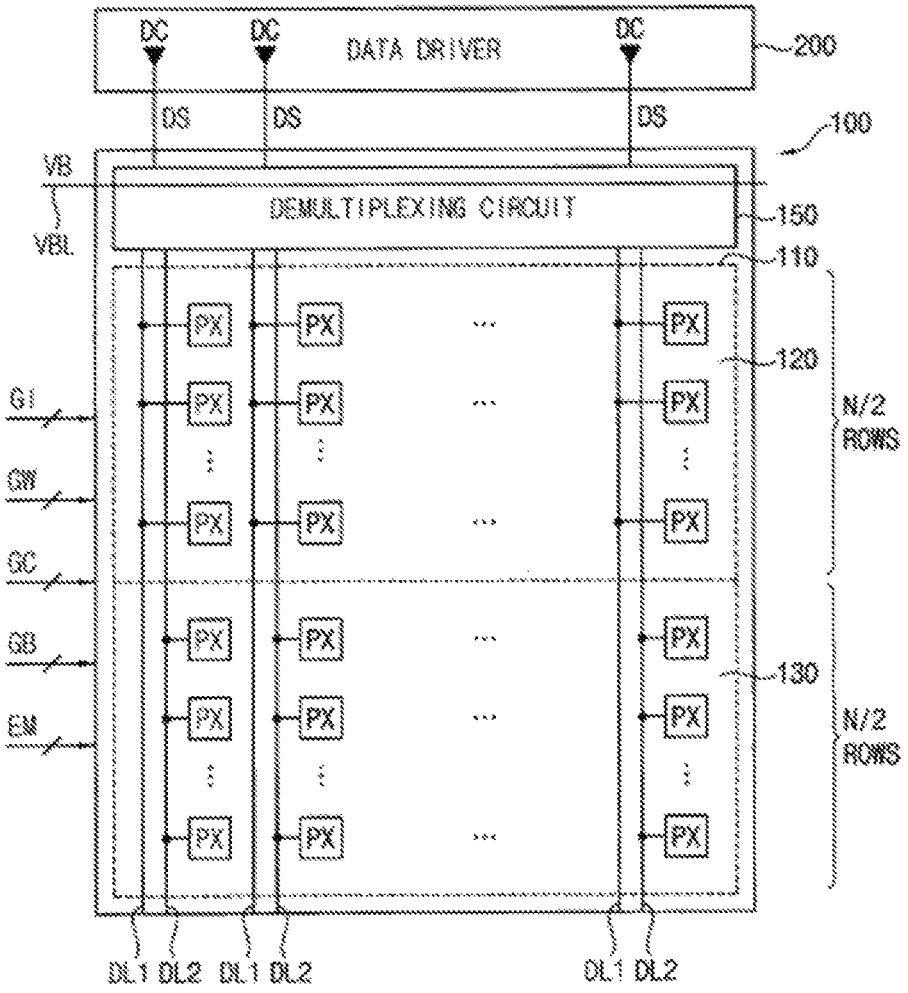
FIG. 1 is a diagram illustrating a display panel of an organic light emitting diode (OLED) display device according to exemplary embodiments.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc.

(hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, embodiments of the present inventive concepts will be explained in detail with reference to the accompanying drawings.

Figure 2:
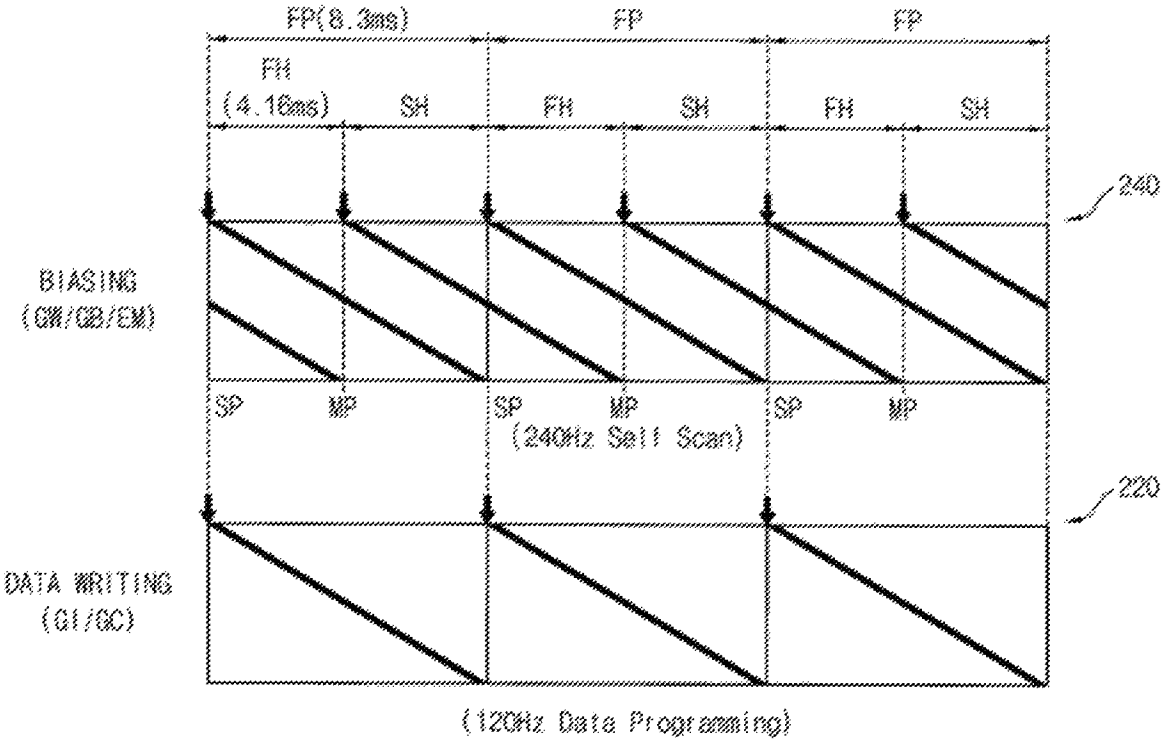
FIG. 2 is a timing diagram illustrating a biasing operation and a data writing operation for a display panel according to exemplary embodiments.

FIG. 1 is a diagram illustrating a display panel of an organic light emitting diode (OLED) display device according to exemplary embodiments, and FIG. 2 is a timing diagram illustrating a biasing operation and a data writing operation for a display panel according to exemplary embodiments.

Referring to FIG. 1, a display panel 100 of an OLED display device according to example embodiments may have a display region 110, and may include a plurality of pixels PX, a plurality of first data lines DL1, a plurality of second data lines DL2 and a demultiplexing circuit 150.

The plurality of pixels PX may be located in the display region 110 of the display panel 100, and may emit light corresponding to data signals DS. In some exemplary embodiments, the plurality of pixels PX may perform a biasing operation that initializes voltage-current characteristics of driving transistors of the pixels PS (e.g., by using a first initialization voltage) and a data writing operation that stores the data signals DS in response to gate initialization signals GI, gate writing signals GW, gate compensation signals GC, gate bypass signals GB and emission signals EM. Further, the plurality of pixels PX may perform the biasing operation (e.g., by using a bias voltage VB of a bias voltage line VBL) in response to the gate writing signals GW, the gate bypass signals GB and the emission signals EM.

The display panel 100 may include the plurality of first and second data lines DL1 and DL2, of which the number may correspond to twice the number of columns of the plurality of pixels PX. For example, the display panel 100 may include one first data line DL and one second data line in each column of the plurality of pixels PX. In the display panel 100, as illustrated in FIG. 1, the plurality of first data lines DL1 and the plurality of second data lines DL2 may extend in a first direction (e.g., a vertical direction), and the plurality of first data lines DL1 and the plurality of second data lines DL2 may be alternately disposed along a second direction (e.g., a horizontal direction) crossing the first direction.

The plurality of first data lines DL1 may be coupled to the plurality of pixels PX located at an upper half 120 of the display region 110, and the plurality of second data lines DL2 may be coupled to the plurality of pixels PX located at a lower half 130 of the display region 110. For example, as illustrated in FIG. 1, the display panel 100 may include N rows of pixels PX in the display region 110, the pixels PX in N/2 rows from a first row to an (N/2)-th row may be coupled to the plurality of first data lines DL1, and the pixels PX in N/2 rows from an (N/2+1)-th row to an N-th row may be coupled to the plurality of second data lines DL2, where N is an integer greater than 1.

The demultiplexing circuit 150 may selectively couple a plurality of data channels DC of a data driver 200 of the OLED display device to the plurality of first data lines DL1 or the plurality of second data lines DL2. In some exemplary embodiments, the demultiplexing circuit 150 may respectively couple the plurality of data channels DC to the plurality of first data lines DL1 during a first half (e.g., a former half) of each frame period, and may respectively couple the plurality of data channels DC to the plurality of second data lines DL2 during a second half (e.g., a latter half) of each frame period. Further, in some exemplary embodiments, the demultiplexing circuit 150 may couple the plurality of second data lines DL2 to the bias voltage line VBL during the first half of each frame period, and may couple the plurality of first data lines DL1 to the bias voltage line VBL during the second half of each frame period.

Hereinafter, an example of the biasing operation and the data writing operation of the display panel 100 having a structure described above will be described below with reference to FIGS. 1 and 2. Reference numeral 220 of FIG. 2 represents a timing of the data writing operation of the display panel 100, and reference numeral 240 of FIG. 2 represents a timing of the biasing operation of the display panel 100.

Referring to FIGS. 1 and 2, the data writing operation for the display panel 100 may be performed at a first frequency (e.g., about 120 Hz), and the biasing operation for the display panel 100 may be performed at a second frequency (e.g., about 240 Hz) higher than the first frequency. For example, as illustrated in FIG. 2, a time length (e.g., about 8.3 ms) of a frame period FP may be determined corresponding to the first frequency (e.g., about 120 Hz), the data writing operation for the display panel 100 may be performed once per each frame period FP, and the biasing operation for the display panel 100 may be performed twice per each frame period FP.

To perform the biasing operation twice while the data writing operation is performed once, during the first half FH (e.g., for about 4.16 ms from a start point SP of the frame period FP) of the frame period FP, the biasing operation and the data writing operation for the pixels PX located at the upper half 120 of the display region 110, or the pixels PX located in the N/2 rows from the first row to the (N/2)-th row may be sequentially performed from the first row to the (N/2)-th row on a row-by-row basis, and the biasing operation for the pixels PX located at the lower half 130 of the display region 110, or the pixels PX located in the N/2 rows from the (N/2+1)-th row to the N-th row may be sequentially performed from the (N/2+1)-th row to the N-th row on the row-by-row basis. Further, during the second half SH (e.g., for about 4.16 ms from a middle point MP of the frame period FP) of the frame period FP, the biasing operation for the pixels PX located at the upper half 120 of the display region 110 may be sequentially performed from the first row to the (N/2)-th row on the row-by-row basis, and the biasing operation and the data writing operation for the pixels PX located at the lower half 130 of the display region 110 may be sequentially performed from the (N/2+1)-th row to the N-th row on the row-by-row basis.

Thus, as illustrated as 220 of FIG. 22, the data writing operation at each frame period FP may be initiated at the start point SP of the frame period FP, and may be sequentially performed from the first row to the N-th row on the row-by-row basis during the frame period FP (e.g., for about 8.3 ms). Further, as illustrated as 240 of FIG. 22, two biasing operations at each frame period FP may be initiated at the start point SP and the middle point MP of the frame period FP, respectively. The biasing operation initiated at the start point SP of the frame period FP may be sequentially performed from the first row to the N-th row on the row-by-row basis during the frame period FP (e.g., for about 8.3 ms), and the biasing operation initiated at the middle point MP of the frame period FP may be sequentially performed from the first row to the N-th row on the row-by-row basis during the second half SH of the frame period FP and the first half FH of the next frame period FP (e.g., for about 4.16 ms+about 4.16 ms, or for a time length of one frame period FP).

As described above, since the biasing operation and the data writing operation are initiated at the start point SP of each frame period FP, and the biasing operation is additionally initiated at the middle point MP of each frame period FP, in a case where the data writing operation is performed at the first frequency of about 120 Hz, the biasing operation may be performed at the second frequency of about 240 Hz higher than the first frequency. The data writing operation may be referred to as a data programming operation. Further, since the biasing operation may be performed within the OLED display device by itself without receiving input image data, the biasing operation may be referred to as a self scan operation. In some exemplary embodiments, the biasing operation and the data writing operation initiated at the start point SP of each frame period FP may be performed in response to the gate initialization signals GI, the gate writing signals GW, the gate compensation signals GC, the gate bypass signals GB and the emission signals EM, and the biasing operation initiated at the middle point MP of each frame period FP may be performed in response to the gate writing signals GW, the gate bypass signals GB and the emission signals EM.

In the display panel 100, driving transistors of the respective pixels PX may have different voltage-current characteristics due to driving hysteresis based on previous and current data signals DS. Accordingly, the respective pixels PX may not emit with desired luminance, and luminance uniformity of the OLED display device may be degraded. To improve the luminance uniformity, a biasing operation that initializes the voltage-current characteristics of the driving transistors by applying a bias (e.g., an on-bias) to the driving transistors may be performed. In a conventional OLED display device, the biasing operation for the driving transistors of the pixels PX may be performed while the data writing operation (or the data programming operation) that the writes (or programs) the data signals DS to the respective pixels PX is performed. Thus, in the conventional OLED display device, a frequency of the biasing is the same as a frequency of the data writing operation. Further, the frequency of the data writing operation may be limited according to a resolution or the number of pixel rows of the conventional OLED display device, and thus the frequency of the biasing operation also may be limited.

However, in the OLED display device including the display panel 100 according to exemplary embodiments, while the biasing operation and the data writing operation for the pixels PX coupled to the plurality of first data lines DL1, or the pixels PX located at the upper half 120 of the display region 110 is performed by applying the data signals DS through the plurality of first data lines DL1 (e.g., during the first half FH of each frame period FP), the biasing operation for the pixels PX coupled to the plurality of second data lines DL2, or the pixels PX located at the lower half 130 of the display region 110 may be additionally performed by applying the bias voltage VB through the plurality of second data lines DL2. Further, while the biasing operation and the data writing operation for the pixels PX coupled to the plurality of second data lines DL2, or the pixels PX located at the lower half 130 of the display region 110 is performed by applying the data signals DS through the plurality of second data lines DL2 (e.g., during the second half SH of each frame period FP), the biasing operation for the pixels PX coupled to the plurality of first data lines DL1, or the pixels PX located at the upper half 120 of the display region 110 may be additionally performed by applying the bias voltage VB through the plurality of first data lines DL1. Accordingly, in the OLED display device including the display panel 100, the biasing operation may be performed at the second frequency (e.g., about 240 Hz) higher than the first frequency (e.g., about 120 Hz) of the data writing operation. Accordingly, the voltage-current characteristics of the driving transistors of the respective pixels PX may be initialized at the higher frequency (e.g., about 240 Hz), and thus the luminance uniformity of the display panel 100 according to exemplary embodiments may be improved.

In some exemplary embodiments, the bias voltage VB applied to the bias voltage line VBL may be higher than the highest data voltage within a data voltage range that is available as the data signals DS. Accordingly, the biasing operation based on the bias voltage VB may initialize the voltage-current characteristics of the driving transistors to a voltage-current characteristic of an on-state by applying the on-bias to the driving transistors of the respective pixels PX. In other exemplary embodiments, the bias voltage VB applied to the bias voltage line VBL may be dynamically changed in each frame period FP. For example, the bias voltage VB may be determined according to data voltages of the data signals DS in each frame period FP (e.g., according to the highest data voltage of the data signals DS in each frame period FP).

Further, in a case where the biasing operation is additionally performed in the conventional OLED display device, since the additional biasing operation for the upper half 120 of the display region 110 and the data writing operation for the lower half 130 of the display region 110 may be substantially simultaneously performed, the data signals DS for the pixels PX in a row (e.g., the (N/2+1)-th row) where the data writing operation is performed may be applied to the pixels PX in a row (e.g., the first row) where the additional biasing operation is performed. Accordingly, in the case where the biasing operation is additionally performed in the conventional OLED display device, a ghost defect where an image for the lower half 130 of the display region 110 is displayed also in the upper half 120 of the display region 110 may occur. However, in the OLED display device including the display panel 100 according to exemplary embodiments, while the data writing operation (along with the biasing operation) for the lower half 130 of the display region 110 is performed by applying the data signals DS to the plurality of second data lines DL2, the additional biasing operation for the upper half 120 of the display region 110 may be performed by applying the bias voltage VB to the plurality of first data lines DL1. Accordingly, in the OLED display device including the display panel 100, although the biasing operation is performed at the second frequency (e.g., about 240 Hz) higher than the first frequency (e.g., about 120 Hz) of the data writing operation, the ghost defect may not occur.

Figure 3:
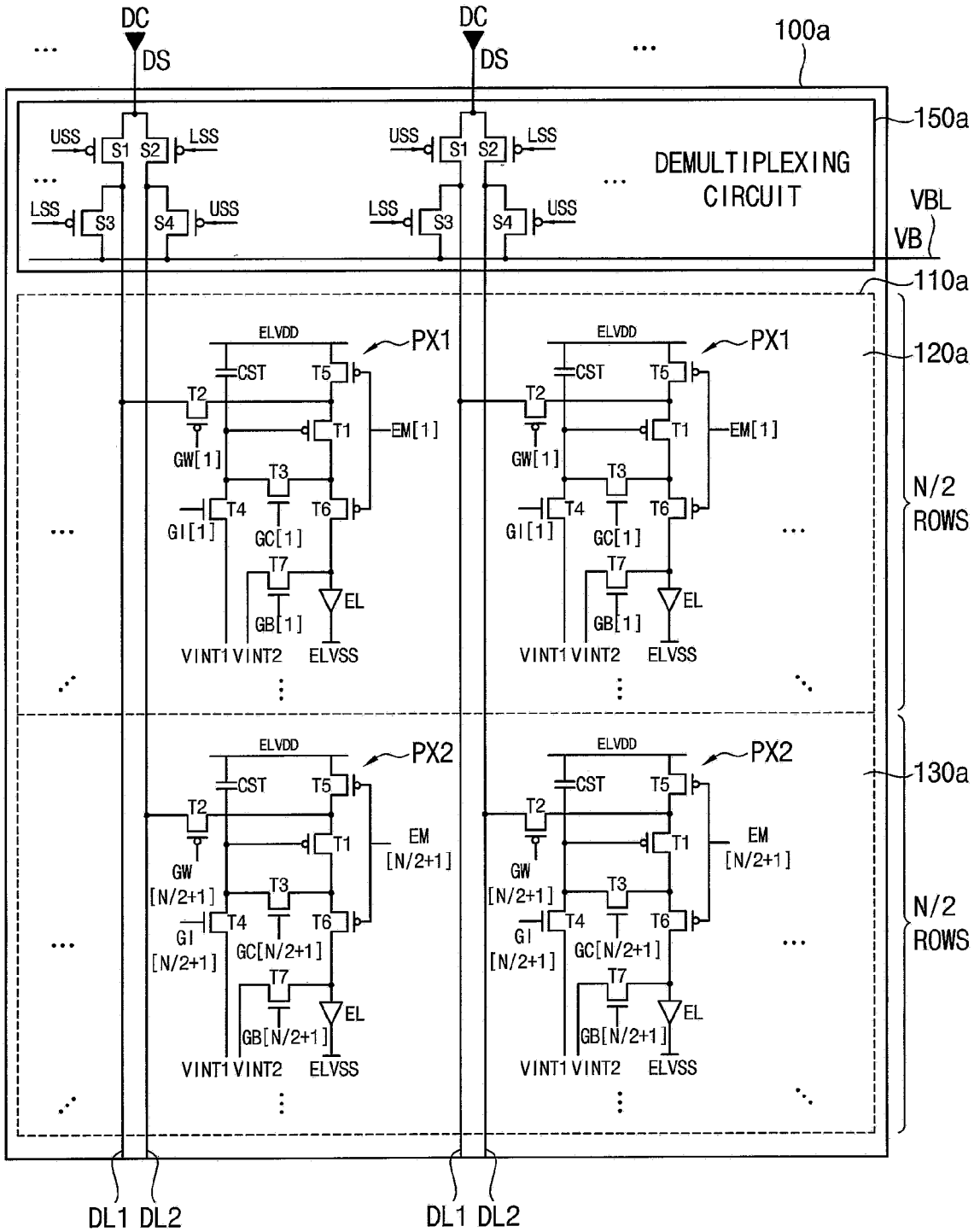
FIG. 3 is a circuit diagram illustrating a display panel of an OLED display device according to exemplary embodiments.
Figure 4:
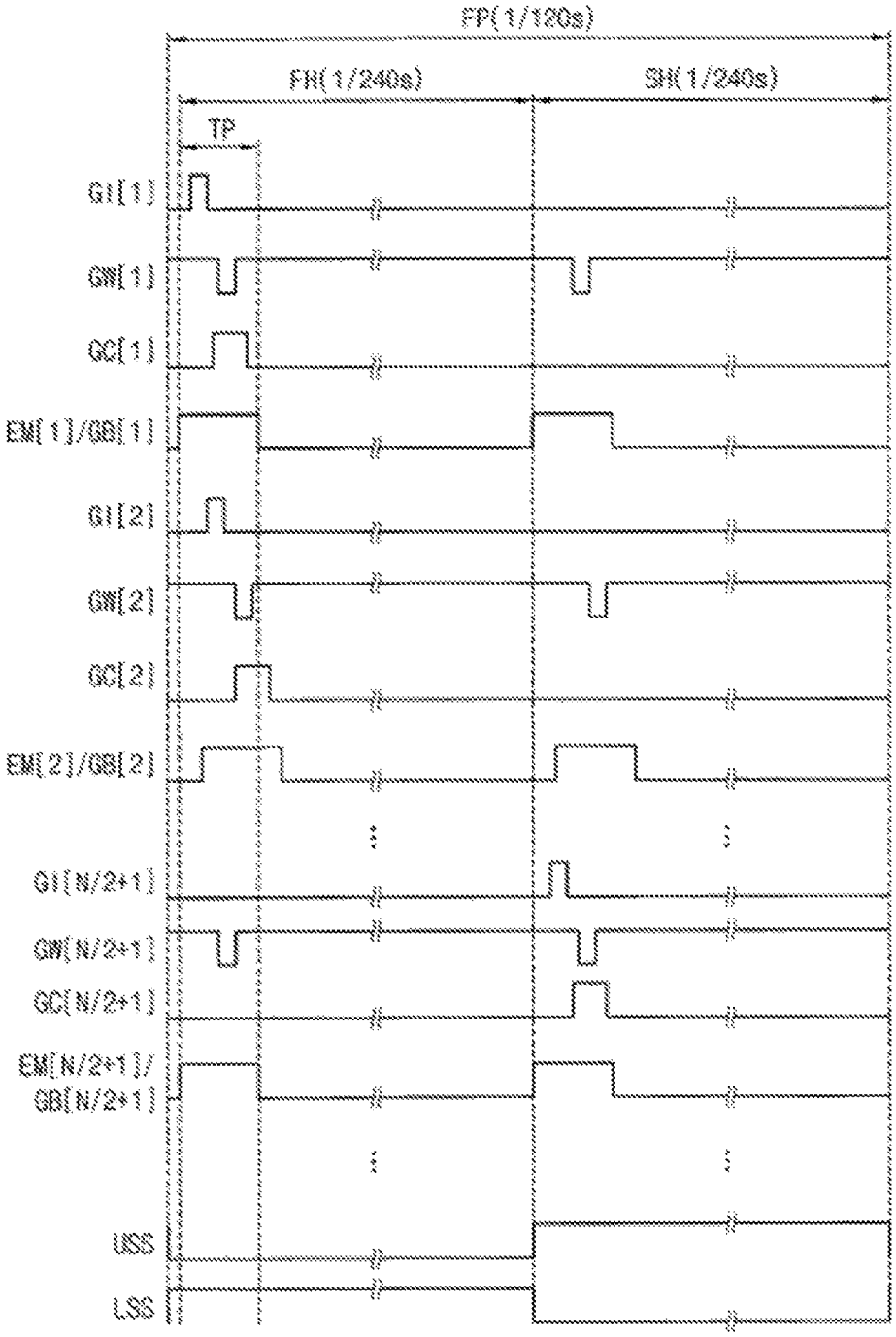
FIG. 4 is a timing diagram for describing an example of an operation of a display panel of FIG. 3.
Figure 5:
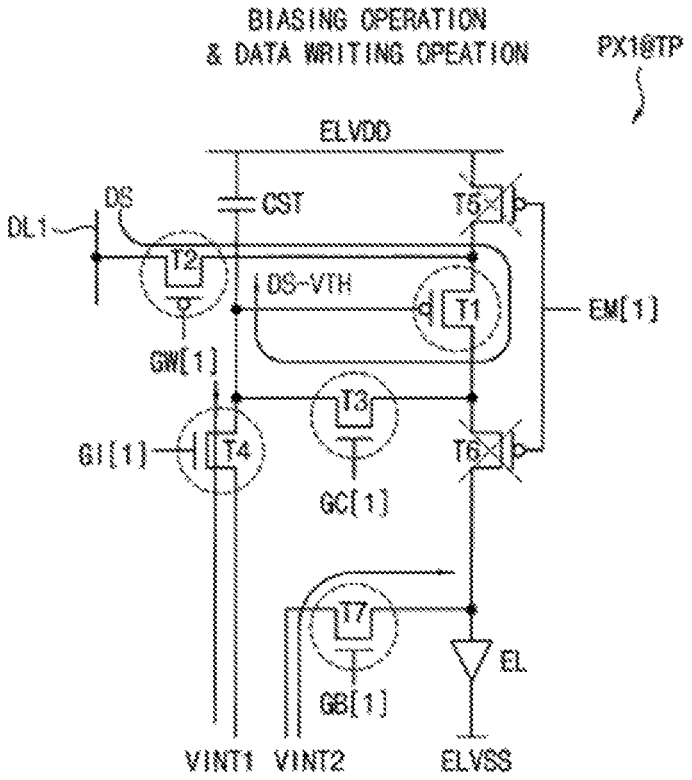
FIG. 5 is a diagram for describing an example of a biasing operation and a data writing operation for a first pixel located at an upper half of a display region during a time period.
Figure 6:
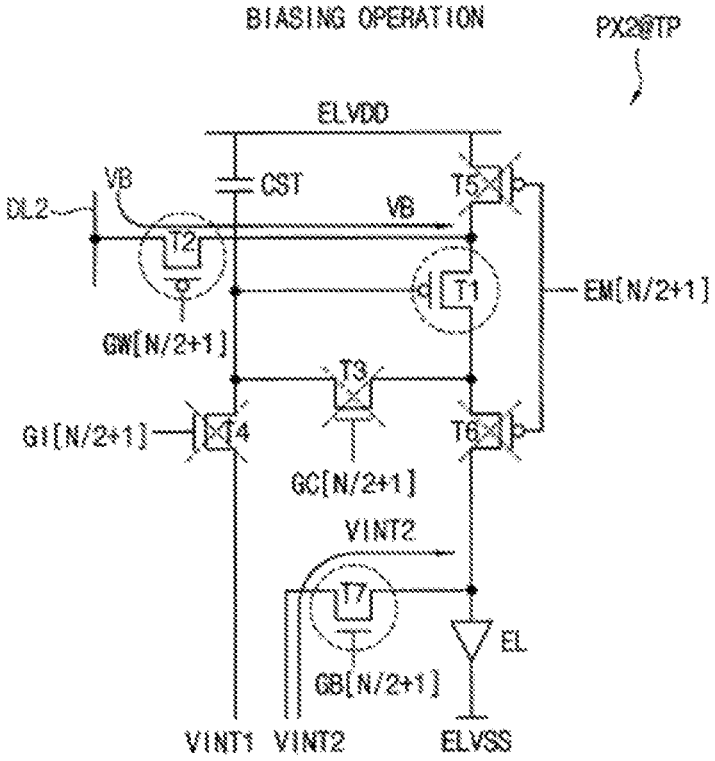
FIG. 6 is a diagram for describing an example of a biasing operation for a second pixel located at a lower half of the display region during the time period.

FIG. 3 is a circuit diagram illustrating a display panel of an OLED display device according to exemplary embodiments, FIG. 4 is a timing diagram for describing an example of an operation of a display panel of FIG. 3, FIG. 5 is a diagram for describing an example of a biasing operation and a data writing operation for a first pixel located at an upper half of a display region during a time period, and FIG. 6 is a diagram for describing an example of a biasing operation for a second pixel located at a lower half of the display region during the time period.

Referring to FIG. 3, a display panel 100*a* of an OLED display device may have a display region 110*a*, and may include a plurality of first pixels PX1 located at an upper half 120*a* of the display region 110*a*, a plurality of second pixels PX2 located at a lower half 130*a* of the display region 110*a*, a plurality of first data lines DL1 coupled to the plurality of first pixels PX1, a plurality of second data lines DL2 coupled to the plurality of second pixels PX2, and a demultiplexing circuit 150*a* that selectively couples a plurality of data channels DC to the plurality of first data lines DL1 or the plurality of second data lines DL2.

The plurality of first pixels PX1 and the plurality of second pixels PX2 may have substantially the same configuration. In some exemplary embodiments, as illustrated in FIG. 3, each of the plurality of first and second pixels PX1 and PX2 may include a capacitor CST, first, second, third, fourth, fifth, sixth and seventh transistors T1, T2, T3, T4, T5, T6 and T7 and an organic light emitting diode EL.

The capacitor CST may store a data signal DS transferred through the second transistor T2 and the (diode-connected) first transistor T1. The capacitor CST may be referred to as a storage capacitor for storing the data signal DS. In some exemplary embodiments, the capacitor CST may include a first electrode coupled to a line of a first power supply voltage ELVDD, and a second electrode coupled to a gate of the first transistor T1.

The first transistor T1 may generate a driving current based on a voltage of the second electrode of the capacitor CST. For example, the first transistor T1 may be referred to as a driving transistor for generating the driving current. In some exemplary embodiments, the first transistor T1 may include a gate coupled to the second electrode of the capacitor CST, a first terminal coupled to the second and fifth transistors T2 and T5, and a second terminal coupled to the third and sixth transistors T3 and T6.

The second transistor T2 may transfer the data signal DS or a bias voltage VB applied to a data line DL1 and DL2 to the first terminal of the first transistor T1 in response to a gate writing signal GW[1] and GW[N/2+1]. For example, the second transistor T2 may be referred to as a switching transistor for transferring a signal/voltage of the data line DL1 and DL2. In some exemplary embodiments, the second transistor T2 may include a gate for receiving the gate writing signal GW[1] and GW[N/2+1], a first terminal coupled to a corresponding one of the plurality of first and second data lines DL1 and DL2, and a second terminal coupled to the first terminal of the first transistor T1. For example, as illustrated in FIG. 3, the first terminal of the second transistor T2 of the first pixel PX1 located at the upper half 120*a* of the display region 110*a* may be coupled to a corresponding one of the plurality of first data lines DL1, and the first terminal of the second transistor T2 of the second pixel PX2 located at the lower half 130*a* of the display region 110*a* may be coupled to a corresponding one of the plurality of second data lines DL2.

The third transistor T3 may diode-connect the first transistor T1 in response to a gate compensation signal GC[1] and GC[N/2+1]. For example, the third transistor T3 may be referred to as a compensation transistor for compensating a threshold voltage of the first transistor T1. In some exemplary embodiments, the third transistor T3 may include a gate for receiving the gate compensation signal GC[1] and GC[N/2+1], a first terminal coupled to the second terminal of the first transistor T1, and a second terminal coupled to the gate of the first transistor T1.

The fourth transistor T4 may apply a first initialization voltage VINT1 to the second electrode of the capacitor CST and the gate of the first transistor T1 in response to a gate initialization signal GI[1] and GI[N/2+1]. For example, the fourth transistor T4 may be referred to as a gate initializing transistor for initializing the capacitor CST and the first transistor T1. If the first initialization voltage VINT1 is applied to the gate of the first transistor T1, a bias (e.g., an on-bias) may be applied to the first transistor T1, and thus a voltage-current characteristic of the first transistor T1 may be initialized. Thus, a biasing operation that is performed substantially simultaneously with a data writing operation for each pixel PX1 and PX2 may be performed using the first initialization voltage VINT1. In some exemplary embodiments, the fourth transistor T4 may include a gate for receiving the gate initialization signal GI[1] and GI[N/2+1], a first terminal coupled to the second electrode of the capacitor CST and the gate of the first transistor T1, and a second terminal coupled to a line of the first initialization voltage VINT1.

The fifth transistor T5 may couple the line of the first power supply voltage ELVDD to the first terminal of the first transistor T1 in response to an emission signal EM[1] and EM[N/2+1], and the sixth transistor T6 may couple the second terminal of the first transistor T1 to an anode of the organic light emitting diode EL in response to the emission signal EM[1] and EM[N/2+1]. For example, the fifth and sixth transistors T5 and T6 may be referred to as emission transistors for forming a path of the driving current. In some exemplary embodiments, the fifth transistor T5 may include a gate for receiving the emission signal EM[1] and EM[N/2+1], a first terminal coupled to the line of the first power supply voltage ELVDD, and a second terminal coupled to the first terminal of the first transistor T1, and the sixth transistor T6 may include a gate for receiving the emission signal EM[1] and EM[N/2+1], a first terminal coupled to second terminal of the first transistor T1, and a second terminal coupled to the anode of the organic light emitting diode EL.

The seventh transistor T7 may apply a second initialization voltage VINT2 to the organic light emitting diode EL in response to a gate bypass signal GB[1] and GB[N/2+1]. For example, the seventh transistor T7 may be referred to as an anode initializing transistor for initializing the anode of the organic light emitting diode EL. In some exemplary embodiments, the seventh transistor T7 may include a gate for receiving the gate bypass signal GB[1] and GB[N/2+1], a first terminal coupled to a line of the second initialization voltage VINT2, and a second terminal coupled to the anode of the organic light emitting diode EL. According to exemplary embodiments, the line of the first initialization voltage VINT1 and the line of the second initialization voltage VINT2 may be the same line or different lines, and the first initialization voltage VINT1 and the second initialization voltage VINT2 may be the same voltage or different voltages.

The organic light emitting diode EL may emit light based on the driving current generated by the first transistor T1 while the fifth and sixth transistors T5 and T6 are turned on. In some exemplary embodiments, the organic light emitting diode EL may include the anode coupled to the second terminal of the sixth transistor T6, and a cathode coupled to a line of a second power supply voltage ELVSS.

In some exemplary embodiments, as illustrated in FIG. 3, the first, second, fifth and sixth transistors T1, T2, T5 and T6 of each of the first and second pixels PX1 and PX2 may be implemented with PMOS transistors, and the third, fourth and seventh transistors T3, T4 and T7 may be implemented with NMOS transistors. In this case where the third, fourth and seventh transistors T3, T4 and T7 are implemented with the NMOS transistors, leakage currents of the third, fourth and seventh transistors T3, T4 and T7 may be reduced. Accordingly, the plurality of first and second pixels PX1 and PX2 may maintain a voltage stored in the capacitor CST for a long time, and thus may be suitable for an OLED display device that performs low frequency driving.

The demultiplexing circuit 150*a* may respectively couple the plurality of data channels DC to the plurality of first data lines DL1 during a first half of each frame period, and may respectively couple the plurality of data channels DC to the plurality of second data lines DL2 during a second half of each frame period. Further, in some exemplary embodiments, the demultiplexing circuit 150*a* may couple the plurality of second data lines DL2 to a bias voltage line VBL during the first half of each frame period, and may couple the plurality of first data lines DL1 to the bias voltage line VBL during the second half of each frame period.

To perform these operations, in some exemplary embodiments, the demultiplexing circuit 150*a* may include a plurality of first switches S1 that respectively couple the plurality of data channels DC to the plurality of first data lines DL1 in response to an upper select signal USS, a plurality of second switches S2 that respectively couple the plurality of data channels DC to the plurality of second data lines DL2 in response to a lower select signal LSS, a plurality of third switches S3 that couple the plurality of first data lines DL1 to the bias voltage line VBL in response to the lower select signal LSS, and a plurality of fourth switches S4 that couple the plurality of second data lines DL2 to the bias voltage line VBL in response to the upper select signal USS. Further, during the first half of each frame period, the upper select signal USS may have an on level (e.g., a low level), and the lower select signal LSS may have an off level (e.g., a high level). Accordingly, during the first half of each frame period, the plurality of first and fourth switches S1 and S4 may be turned on, the data signals DS may be applied to the plurality of first data lines DL1 through the plurality of data channels DC, and the bias voltage VB may be applied to the plurality of second data lines DL2 through the bias voltage line VBL. Further, during the second half of the frame period, the upper select signal USS may have the off level, and the lower select signal LSS may have the on level. Accordingly, during the second half of each frame period, the plurality of second and third switches S2 and S3 may be turned on, the data signals DS may be applied to the plurality of second data lines DL2 through the plurality of data channels DC, and the bias voltage VB may be applied to the plurality of first data lines DL1 through the bias voltage line VBL.

Hereinafter, an operation of the display panel 100*a* will be described below with reference to FIGS. 3 through 6.

Referring to FIGS. 3 and 4, the display panel 100*a* may include N rows of pixels PX1 and PX2. In each frame period FP (e.g., a frame period having a time length (e.g., about 1/120S) corresponding to a frequency of about 120 Hz), the N rows of pixels PX1 and PX2 may sequentially receive the gate initialization signals GI[1], GI[2], . . . , GI[N/2+1], . . . , the gate writing signals GW[1], GW[2], . . . , GW[N/2+1], . . . , the gate compensation signals GC[1], GC[2], . . . , GC[N/2+1], . . . , the gate bypass signals GB[1], GB[2], . . . , GB[N/2+1], . . . and the emission signals EM[1], EM[2], . . . , EM[N/2+1], . . . on the row-by-row basis. The N rows of pixels PX1 and PX2 may sequentially perform the biasing operation and the data writing operation on the row-by-row basis in response to the gate initialization signals GI[1], GI[2], . . . , GI[N/2+1], . . . , the gate writing signals GW[1], GW[2], . . . , GW[N/2+1], . . . , the gate compensation signals GC[1], GC[2], . . . , GC[N/2+1], . . . , the gate bypass signals GB[1], GB[2], . . . , GB[N/2+1], . . . and the emission signals EM[1], EM[2], . . . , EM[N/2+1], . . . illustrated in FIG. 4.

In some exemplary embodiments, as illustrated in FIG. 4, the gate writing signals GW[1], GW[2], . . . , GW[N/2+1], . . . and the emission signals EM[1], EM[2], . . . , EM[N/2+1], . . . , applied to the second, fifth and sixth transistors T2, T5 and T6 of the pixels PX1 and PX2 implemented with the PMOS transistors may be active low signals that have a low level as an on level, and the gate compensation signals GC[1], GC[2], . . . , GC[N/2+1], . . . , the gate initialization signals GI[1], GI[2], . . . , GI[N/2+1], . . . and the gate bypass signals GB[1], GB[2], . . . , GB[N/2+1], . . . applied to the third, fourth and seventh transistors T3, T4 and T7 of the pixels PX1 and PX2 implemented with the NMOS transistors may be active high signals that have a high level as the on level. Further, in some exemplary embodiments, as illustrated in FIG. 4, the emission signals EM[1], EM[2], . . . , EM[N/2+1], . . . for the pixels PX1 and PX2 may be used as the gate bypass signals GB[1], GB[2], . . . , GB[N/2+1], . . . .

Further, in the first half FH (e.g., of about 1/240S) of each frame period FP, while the first pixels PX1 located at the upper half 120*a* of the display region 110*a* sequentially receive the gate initialization signals GI[1], GI[2], . . . , the gate writing signals GW[1], GW[2], . . . , the gate compensation signals GC[1], GC[2], . . . , the gate bypass signals GB[1], GB[2], . . . and the emission signals EM[1], EM[2], . . . on the row-by-row basis, the second pixels PX2 located at the lower half 130*a* of the display region 110*a* may sequentially receive the gate writing signals GW[N/2+1], . . . , the gate bypass signals GB[N/2+1], . . . and the emission signals EM[N/2+1], on the row-by-row basis. Further, during the first half FH of each frame period FP, the upper select signal USS may have the on level (e.g., the low level), and the lower select signal LSS may have the off level (e.g., the high level). Thus, in the first half FH of each frame period FP, the demultiplexing circuit 150*a* may couple the plurality of data channels DC to the plurality of first data lines DL1, and may couple the plurality of second data lines DL2 to the bias voltage line VBL. Accordingly, in the first half FH of each frame period FP, the first pixels PX1 coupled to the plurality of data channels DC may sequentially perform the biasing operation and the data writing operation on the row-by-row basis, and the second pixels PX2 coupled to the bias voltage line VBL may sequentially perform the biasing operation on the row-by-row basis.

For example, in a time period TP within the first half FH of each frame period FP, the gate initialization signal GI[1], the gate writing signal GW[1], the gate compensation signal GC[1] and the gate bypass signal GB[1] having the on level may be applied to a first row of the first pixels PX1, and the emission signal EM[1] having the off level may be applied to the first row of the first pixels PX1. At substantially the same time, or in the time period TP, the gate writing signal GW[N/2+1] and the gate bypass signal GB[N/2+1] having the on level may be applied to an (N/2+1)-th row of the second pixels PX2, and the emission signal EM[N/2+1] having the off level may be applied to the (N/2+1)-th row of the second pixels PX2. Accordingly, the first row of the first pixels PX1 may perform the biasing operation and the data writing operation, and, substantially simultaneously, the (N/2+1)-th row of the second pixels PX2 may perform the biasing operation.

For example, as illustrated in FIG. 5, the first pixel PX1@TP in the time period TP may perform the biasing operation and the data writing operation in response to the gate initialization signal GI[1], the gate writing signal GW[1], the gate compensation signal GC[1] and the gate bypass signal GB[1] while the emission signal EM[1] has the off level. While the emission signal EM[1] that is the active low signal has the off level, the gate bypass signal GB[1] that is the active high signal may have the on level, the seventh transistor T7 may initialize the organic light emitting diode EL by applying the second initialization voltage VINT2 to the anode of the organic light emitting diode EL in response to the gate bypass signal GB[1]. Further, the fourth transistor T4 may initialize the capacitor CST and the first transistor T1 by applying the first initialization voltage VINT1 to the second electrode of the capacitor CST and the gate of the first transistor T1 in response to the gate initialization signal GI[1]. In some exemplary embodiments, the line of the first initialization voltage VINT1 and the line of the second initialization voltage VINT2 may be the same line, and the first initialization voltage VINT1 and the second initialization voltage VINT2 may be the same voltage. If the first initialization voltage VINT1 is applied to the gate of the first transistor T1, a voltage-current characteristic of the first transistor T1 may be initialized by a bias (e.g., an on-bias) applied to the first transistor T1, which may be referred to as the biasing operation performed along with the data writing operation. Thereafter, the second transistor T2 may be turned on in response to the gate writing signal GW[1], and the third transistor T3 may be turned on in response to the gate compensation signal GC[1]. In this case, the third transistor T3 may diode-connect the first transistor T1, the data signal DS applied to the first data line DL1 may be transferred to the capacitor CST through the second transistor T2 and the diode-connected first transistor T1. Since the data signal DS is transferred through the diode-connected first transistor T1, the capacitor CST may store a voltage DS-VTH that is a threshold voltage VTH subtracted from the data signals DS. Storing the voltage DS-VTH in the capacitor CST may be referred to as the data writing operation. As described above, the first pixel PX1@TP in the time period TP may perform the biasing operation and the data writing operation.

Further, as illustrated in FIG. 6, the second pixel PX2@TP in the time period TP may perform the biasing operation in response to the gate writing signal GW[N/2+1] and the gate bypass signal GB[N/2+1] while the emission signal EM[N/2+1] has the off level. The seventh transistor T7 may initialize the organic light emitting diode EL by applying the second initialization voltage VINT2 to the anode of the organic light emitting diode EL in response to the gate bypass signal GB[N/2+1]. Further, the second transistor T2 may be turned on in response to the gate writing signal GW[N/2+1]. In this case, the bias voltage VB applied to the second data line DL2 coupled to the bias voltage line VBL may be applied to the first terminal of the first transistor T1. In some exemplary embodiments, the bias voltage VB may be higher than or equal to the highest data voltage within a data voltage range that is available as the data signal DS. Since the voltage DS-VTH at the second terminal of the capacitor CST in a previous frame period is applied to gate of the first transistor T1, and the bias voltage VB higher than or equal to the highest data voltage is applied to the first terminal of the first transistor T1, the bias (e.g., the on-bias) may be applied to the first transistor T1, and the voltage-current characteristic of the first transistor T1 may be initialized by the bias applied to the first transistor T1, which may be referred to as the biasing operation performed separately from the data writing operation. In the time period TP, although the first pixel PX1@TP performs the biasing operation and the data writing operation, the second pixel PX2@TP may receive the bias voltage VB through the second data line DL2 that is different from the first data line DL1 coupled to the first pixel first pixel PX1@TP, and thus may perform the biasing operation using the bias voltage VB received through the second data line DL2 without the ghost defect.

Referring again to FIG. 4, in the second half SH (e.g., of about 1/240S) of each frame period FP, while the second pixels PX2 located at the lower half 130*a* of the display region 110*a* sequentially receive the gate initialization signals GI[N/2+1], . . . , the gate writing signals GW[N/2+1], . . . , the gate compensation signals GC[N/2+1], . . . , the gate bypass signals GB[N/2+1], . . . and the emission signals EM[N/2+1], . . . on the row-by-row basis, the first pixels PX1 located at the upper half 120*a* of the display region 110*a* may sequentially receive the gate writing signals GW[1], GW[2], . . . , the gate bypass signals GB[1], GB[2], . . . and the emission signals EM[1], EM[2], . . . on the row-by-row basis. Further, during the second half SH of each frame period FP, the upper select signal USS may have the off level, and the lower select signal LSS may have the on level. Thus, in the second half SH of each frame period FP, the demultiplexing circuit 150*a* may couple the plurality of data channels DC to the plurality of second data lines DL2, and may couple the plurality of first data lines DL1 to the bias voltage line VBL. Accordingly, in the second half SH of each frame period FP, the second pixels PX2 coupled to the plurality of data channels DC may sequentially perform the biasing operation and the data writing operation on the row-by-row basis, and the first pixels PX1 coupled to the bias voltage line VBL may sequentially perform the biasing operation on the row-by-row basis.

As described above, in the display panel 100*a* according to exemplary embodiments, in the first half FH of each frame period FP, while the first pixels PX1 located at the upper half 120*a* of the display region 110*a* perform the biasing operation and the data writing operation by using the plurality of first data lines DL1, the second pixels PX2 located at the lower half 130*a* of the display region 110*a* may perform the biasing operation by using the plurality of second data lines DL2. Further, in the second half SH of each frame period FP, while the second pixels PX2 located at the lower half 130*a* of the display region 110*a* perform the biasing operation and the data writing operation by using the plurality of second data lines DL2, the first pixels PX1 located at the upper half 120*a* of the display region 110*a* may perform the biasing operation by using the plurality of first data lines DL1. Accordingly, in the display panel 100*a* according to exemplary embodiments, the biasing operation may be performed at the second frequency (e.g., about 240 Hz) higher than the first frequency (e.g., about 120 Hz) of the data writing operation without the ghost defect.

Figure 7:
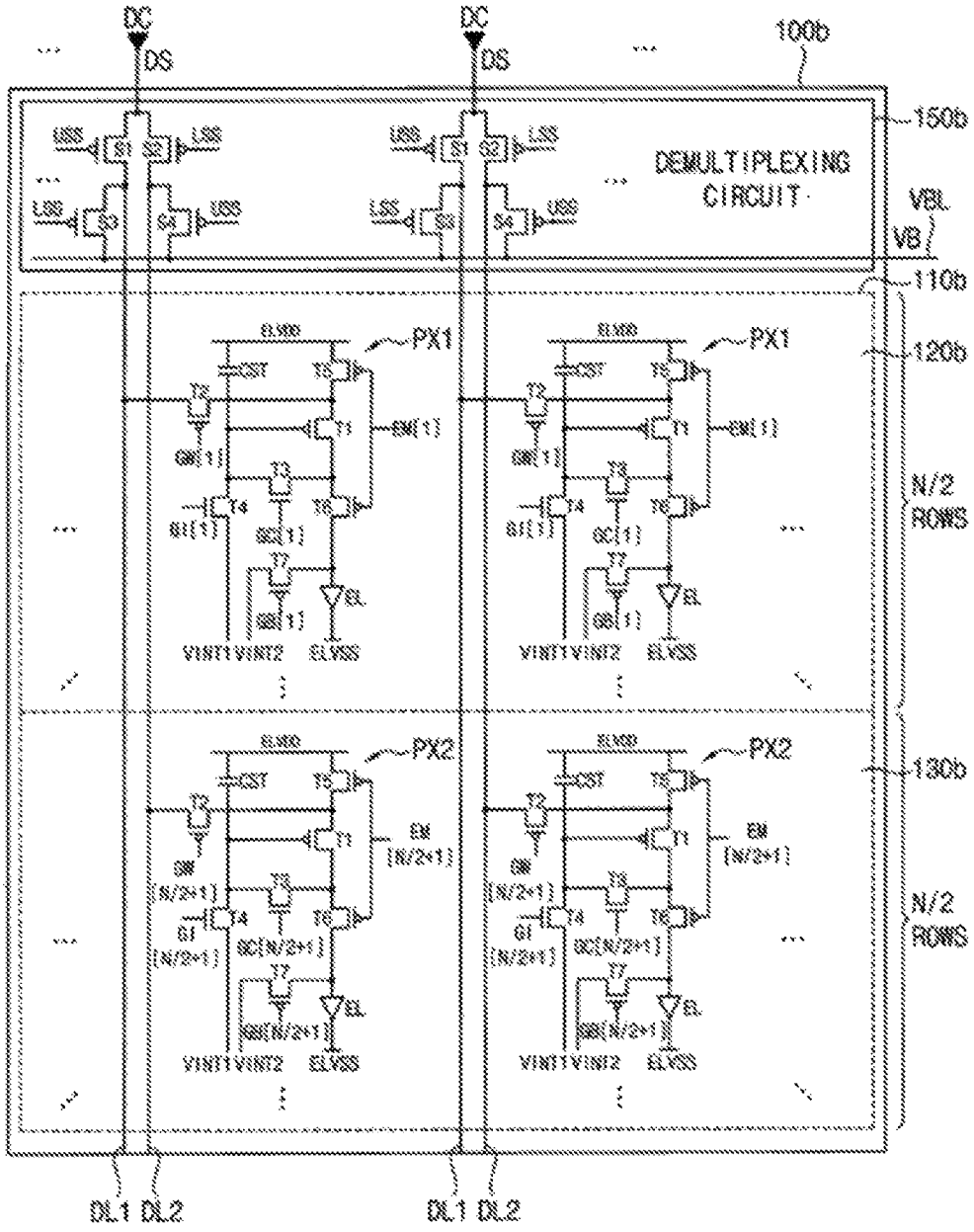
FIG. 7 is a circuit diagram illustrating a display panel of an OLED display device according to example embodiments.
Figure 8:
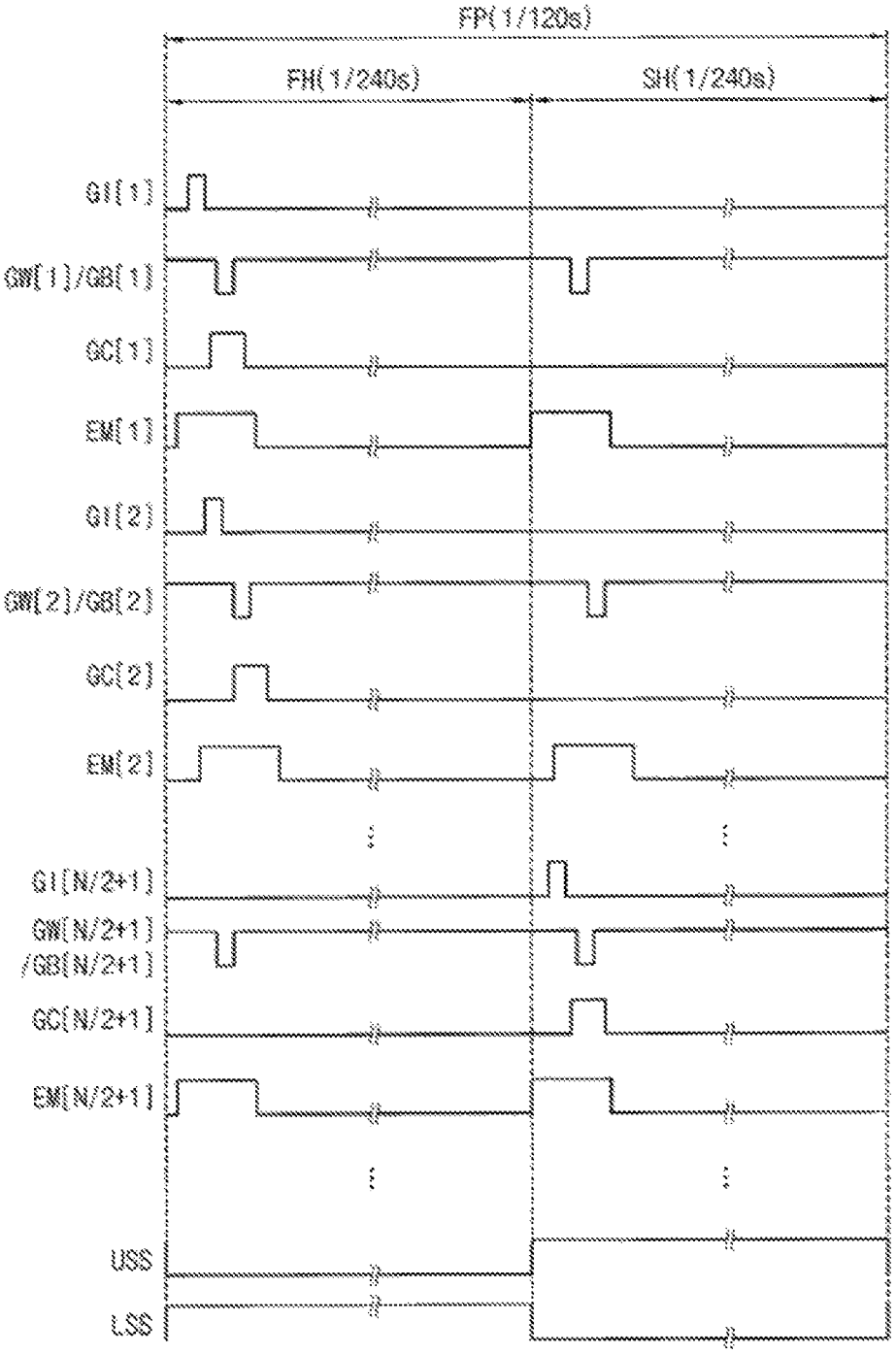
FIG. 8 is a timing diagram for describing an example of an operation of a display panel of FIG. 7.

FIG. 7 is a circuit diagram illustrating a display panel of an OLED display device according to exemplary embodiments, and FIG. 8 is a timing diagram for describing an example of an operation of a display panel of FIG. 7.

Referring to FIG. 7, a display panel 100*b* of an OLED display device may have a display region 110*b*, and may include a plurality of first pixels PX1 located at an upper half 120*b* of the display region 110*b*, a plurality of second pixels PX2 located at a lower half 130*b* of the display region 110*b*, a plurality of first data lines DL1 coupled to the plurality of first pixels PX1, a plurality of second data lines DL2 coupled to the plurality of second pixels PX2, and a demultiplexing circuit 150*b* that selectively couples a plurality of data channels DC to the plurality of first data lines DL1 or the plurality of second data lines DL2. The display panel 100*b* of FIG. 7 may have a similar configuration and a similar operation to a display panel 100*a* of FIG. 3, except that a seventh transistor T7 of each pixel PX1 and PX2 may be implemented with a PMOS transistor.

In the display panel 100*b*, first, second, fifth, sixth and seventh transistors T1, T2, T5, T6 and T7 of each pixel PX1 and PX2 may be implemented with PMOS transistors, and third and fourth transistors T3 and T4 may be implemented with NMOS transistors. Thus, as illustrated in FIG. 8, gate writing signals GW[1], GW[2], . . . , GW[N/2+1], . . . , emission signals EM[1], EM[2], . . . , EM[N/2+1], . . . and gate bypass signals GB[1], GB[2], . . . , GB[N/2+1], . . .

applied to the second, fifth, sixth and seventh transistors T2, T5, T6 and T7 may be active low signals that have a low level as an on level, and gate compensation signals GC[1], GC[2], . . . , GC[N/2+1], . . . and gate initialization signals GI[1], GI[2], . . . , GI[N/2+1], . . . applied to the third and fourth transistors T3 and T4 may be active high signals that have a high level as the on level. Further, in some exemplary embodiments, as illustrated in FIG. 8, the gate writing signal (e.g., GW[1]) for a current row may be used as the gate bypass signal (e.g., GB[1]) for the current row. In other exemplary embodiments, the gate writing signal (e.g., GW[1]) for a previous row may be used as the gate bypass signal (e.g., GB[2]) for the current row. In still other exemplary embodiments, the gate writing signal (e.g., GW[2]) for a next row may be used as the gate bypass signal (e.g., GB[1]) for the current row.

As illustrated in FIG. 8, in a first half FH of each frame period FP, while the first pixels PX1 located at the upper half 120*b* of the display region 110*b* sequentially receive the gate initialization signals GI[1], GI[2], . . . , the gate writing signals GW[1], GW[2], . . . , the gate compensation signals GC[1], GC[2], . . . , the gate bypass signals GB[1], GB[2], . . . and the emission signals EM[1], EM[2], . . . on a row-by-row basis, the second pixels PX2 located at the lower half 130*b* of the display region 110*b* may sequentially receive the gate writing signals GW[N/2+1], . . . , the gate bypass signals GB[N/2+1], . . . and the emission signals EM[N/2+1], on the row-by-row basis. Further, during the first half FH of each frame period FP, an upper select signal USS may have an on level, and a lower select signal LSS may have an off level. Thus, in the first half FH of each frame period FP, the demultiplexing circuit 150*b* may couple the plurality of data channels DC to the plurality of first data lines DL1, and may couple the plurality of second data lines DL2 to a bias voltage line VBL. Accordingly, in the first half FH of each frame period FP, the first pixels PX1 coupled to the plurality of data channels DC may sequentially perform the biasing operation and the data writing operation on the row-by-row basis, and the second pixels PX2 coupled to the bias voltage line VBL may sequentially perform the biasing operation on the row-by-row basis.

Further, in a second half SH of each frame period FP, while the second pixels PX2 located at the lower half 130*b* of the display region 110*b* sequentially receive the gate initialization signals GI[N/2+1], . . . , the gate writing signals GW[N/2+1], . . . , the gate compensation signals GC[N/2+1], . . . , the gate bypass signals GB[N/2+1], . . . and the emission signals EM[N/2+1], . . . on the row-by-row basis, the first pixels PX1 located at the upper half 120*b* of the display region 110*b* may sequentially receive the gate writing signals GW[1], GW[2], . . . , the gate bypass signals GB[1], GB[2], . . . and the emission signals EM[1], EM[2], . . . on the row-by-row basis. Further, during the second half SH of each frame period FP, the upper select signal USS may have the off level, and the lower select signal LSS may have the on level. Thus, in the second half SH of each frame period FP, the demultiplexing circuit 150*b* may couple the plurality of data channels DC to the plurality of second data lines DL2, and may couple the plurality of first data lines DL1 to the bias voltage line VBL. Accordingly, in the second half SH of each frame period FP, the second pixels PX2 coupled to the plurality of data channels DC may sequentially perform the biasing operation and the data writing operation on the row-by-row basis, and the first pixels PX1 coupled to the bias voltage line VBL may sequentially perform the biasing operation on the row-by-row basis.

As described above, in the display panel 100*b* according to exemplary embodiments, in the first half FH of each frame period FP, while the first pixels PX1 located at the upper half 120*b* of the display region 110*b* perform the biasing operation and the data writing operation by using the plurality of first data lines DL1, the second pixels PX2 located at the lower half 130*b* of the display region 110*b* may perform the biasing operation by using the plurality of second data lines DL2. Further, in the second half SH of each frame period FP, while the second pixels PX2 located at the lower half 130*b* of the display region 110*b* perform the biasing operation and the data writing operation by using the plurality of second data lines DL2, the first pixels PX1 located at the upper half 120*b* of the display region 110*b* may perform the biasing operation by using the plurality of first data lines DL1. Accordingly, in the display panel 100*b* according to exemplary embodiments, the biasing operation may be performed at a second frequency (e.g., about 240 Hz) higher than a first frequency (e.g., about 120 Hz) of the data writing operation without a ghost defect.

Figure 9:
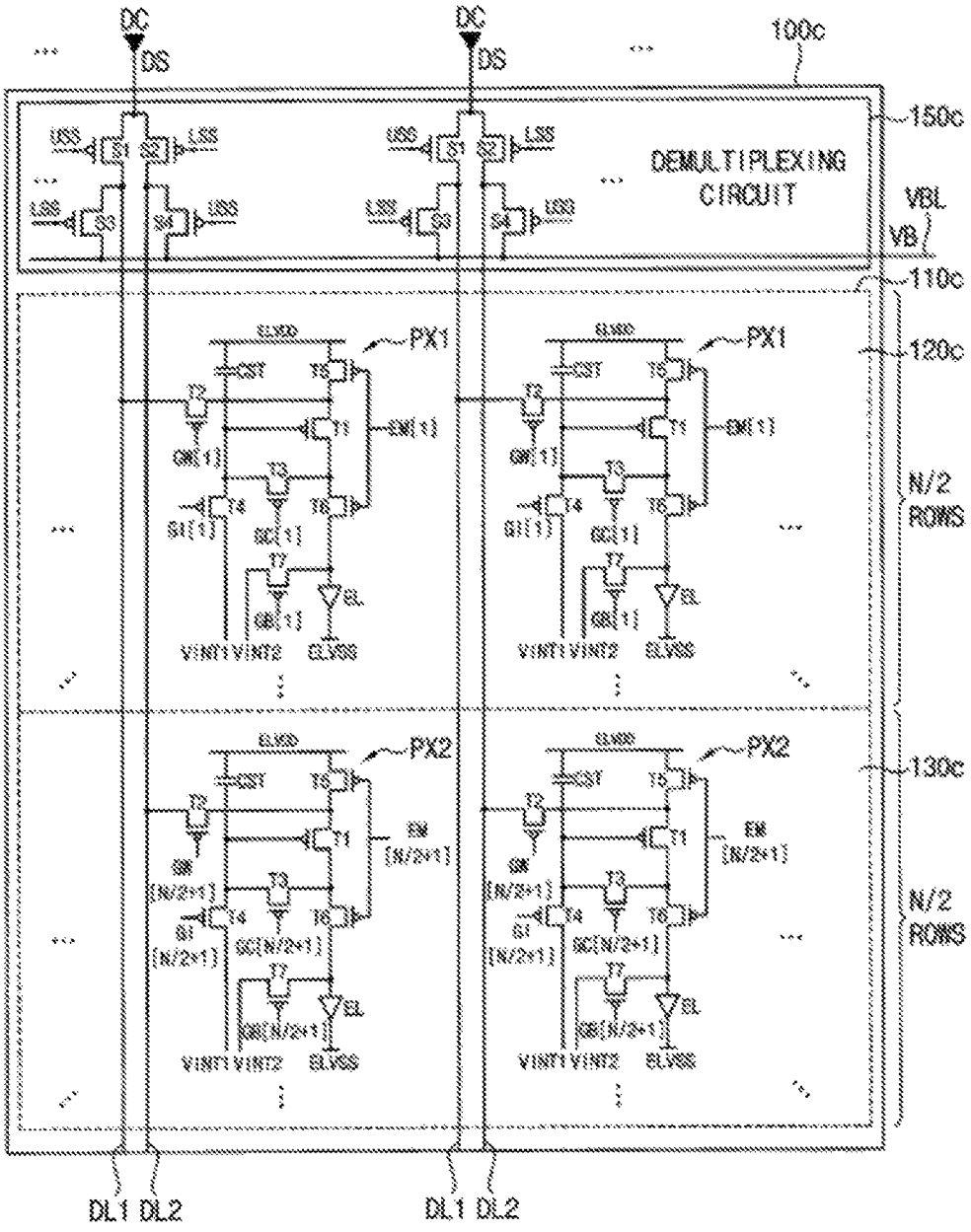
FIG. 9 is a circuit diagram illustrating a display panel of an OLED display device according to exemplary embodiments.
Figure 10:
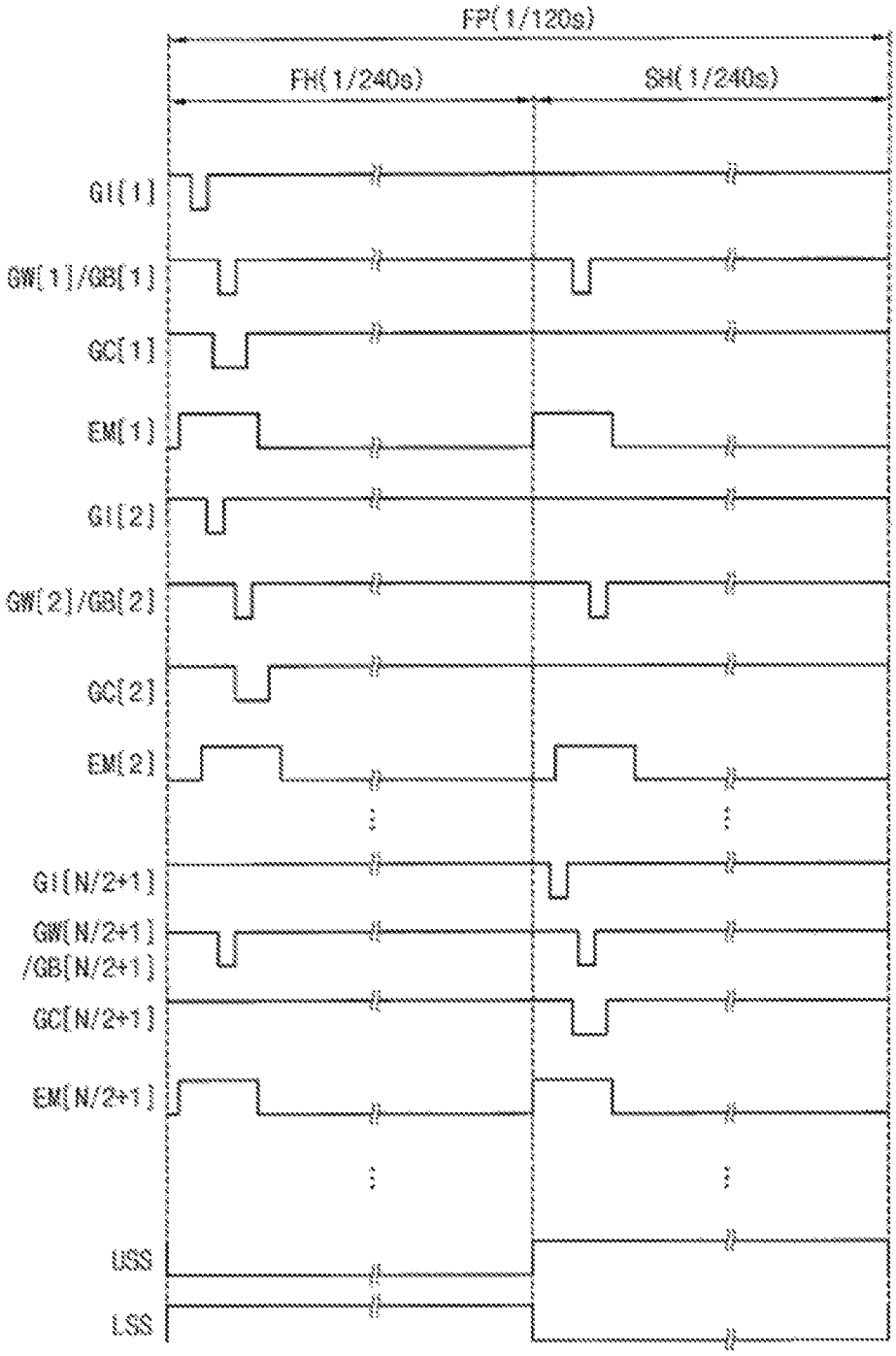
FIG. 10 is a timing diagram for describing an example of an operation of a display panel of FIG. 9.

FIG. 9 is a circuit diagram illustrating a display panel of an OLED display device according to exemplary embodiments, and FIG. 10 is a timing diagram for describing an example of an operation of a display panel of FIG. 9.

Referring to FIG. 9, a display panel 100*c* of an OLED display device may have a display region 110*c*, and may include a plurality of first pixels PX1 located at an upper half 120*c* of the display region 110*c*, a plurality of second pixels PX2 located at a lower half 130*c* of the display region 110*c*, a plurality of first data lines DL1 coupled to the plurality of first pixels PX1, a plurality of second data lines DL2 coupled to the plurality of second pixels PX2, and a demultiplexing circuit 150*c* that selectively couples a plurality of data channels DC to the plurality of first data lines DL1 or the plurality of second data lines DL2. The display panel 100*c* of FIG. 9 may have a similar configuration and a similar operation to a display panel 100*a* of FIG. 3 or a display panel 100*b* of FIG. 7, except that all of first through seventh transistors T1 through T7 of each pixel PX1 and PX2 may be implemented with PMOS transistors.

In the display panel 100*c*, all of the first through seventh transistors T1 through T7 of each pixel PX1 and PX2 may be implemented with the PMOS transistors. Thus, as illustrated in FIG. 10, gate initialization signals GI[1], GI[2], . . . , GI[N/2+1], . . . , gate writing signals GW[1], GW[2], . . . , GW[N/2+1], . . . , gate compensation signals GC[1], GC[2], . . . , GC[N/2+1], . . . , gate bypass signals GB[1], GB[2], . . . , GB[N/2+1], . . . and emission signals EM[1], EM[2], . . . , EM[N/2+1], . . . applied to the second through seventh transistors T2 through T7 may be active low signals that have a low level as an on level. In some exemplary embodiments, as illustrated in FIG. 10, the gate writing signal (e.g., GW[1]) for a current row may be used as the gate bypass signal (e.g., GB[1]) for the current row. In other exemplary embodiments, the gate writing signal (e.g., GW[1]) for a previous row may be used as the gate bypass signal (e.g., GB[2]) for the current row. In still other exemplary embodiments, the gate writing signal (e.g., GW[2]) for a next row may be used as the gate bypass signal (e.g., GB[1]) for the current row.

As illustrated in FIG. 10, in a first half FH of each frame period FP, while the first pixels PX1 located at the upper half 120*c* of the display region 110*c* sequentially receive the gate initialization signals GI[1], GI[2], . . . , the gate writing signals GW[1], GW[2], . . . , the gate compensation signals GC[1], GC[2], . . . , the gate bypass signals GB[1], GB[2], . . . and the emission signals EM[1], EM[2], . . . on a row-by-row basis, the second pixels PX2 located at the lower half 130*c* of the display region 110*c* may sequentially receive the gate writing signals GW[N/2+1], . . . , the gate bypass signals GB[N/2+1], . . . and the emission signals EM[N/2+1], . . . on the row-by-row basis. Further, during the first half FH of each frame period FP, an upper select signal USS may have an on level, and a lower select signal LSS may have an off level. Thus, in the first half FH of each frame period FP, the demultiplexing circuit 150*c* may couple the plurality of data channels DC to the plurality of first data lines DL1, and may couple the plurality of second data lines DL2 to a bias voltage line VBL. Accordingly, in the first half FH of each frame period FP, the first pixels PX1 coupled to the plurality of data channels DC may sequentially perform the biasing operation and the data writing operation on the row-by-row basis, and the second pixels PX2 coupled to the bias voltage line VBL may sequentially perform the biasing operation on the row-by-row basis.

Further, in a second half SH of each frame period FP, while the second pixels PX2 located at the lower half 130*c* of the display region 110*c* sequentially receive the gate initialization signals GI[N/2+1], . . . , the gate writing signals GW[N/2+1], . . . , the gate compensation signals GC[N/2+1], . . . , the gate bypass signals GB[N/2+1], . . . and the emission signals EM[N/2+1], . . . on the row-by-row basis, the first pixels PX1 located at the upper half 120*c* of the display region 110*c* may sequentially receive the gate writing signals GW[1], GW[2], . . . , the gate bypass signals GB[1], GB[2], . . . and the emission signals EM[1], EM[2], on the row-by-row basis. Further, during the second half SH of each frame period FP, the upper select signal USS may have the off level, and the lower select signal LSS may have the on level. Thus, in the second half SH of each frame period FP, the demultiplexing circuit 150*c* may couple the plurality of data channels DC to the plurality of second data lines DL2, and may couple the plurality of first data lines DL1 to the bias voltage line VBL. Accordingly, in the second half SH of each frame period FP, the second pixels PX2 coupled to the plurality of data channels DC may sequentially perform the biasing operation and the data writing operation on the row-by-row basis, and the first pixels PX1 coupled to the bias voltage line VBL may sequentially perform the biasing operation on the row-by-row basis.

As described above, in the display panel 100*c* according to exemplary embodiments, in the first half FH of each frame period FP, while the first pixels PX1 located at the upper half 120*c* of the display region 110*c* perform the biasing operation and the data writing operation by using the plurality of first data lines DL1, the second pixels PX2 located at the lower half 130*c* of the display region 110*c* may perform the biasing operation by using the plurality of second data lines DL2. Further, in the second half SH of each frame period FP, while the second pixels PX2 located at the lower half 130*c* of the display region 110*c* perform the biasing operation and the data writing operation by using the plurality of second data lines DL2, the first pixels PX1 located at the upper half 120*c* of the display region 110*c* may perform the biasing operation by using the plurality of first data lines DL1. Accordingly, in the display panel 100*c* according to exemplary embodiments, the biasing operation may be performed at a second frequency (e.g., about 240 Hz) higher than a first frequency (e.g., about 120 Hz) of the data writing operation without a ghost defect.

Figure 11:
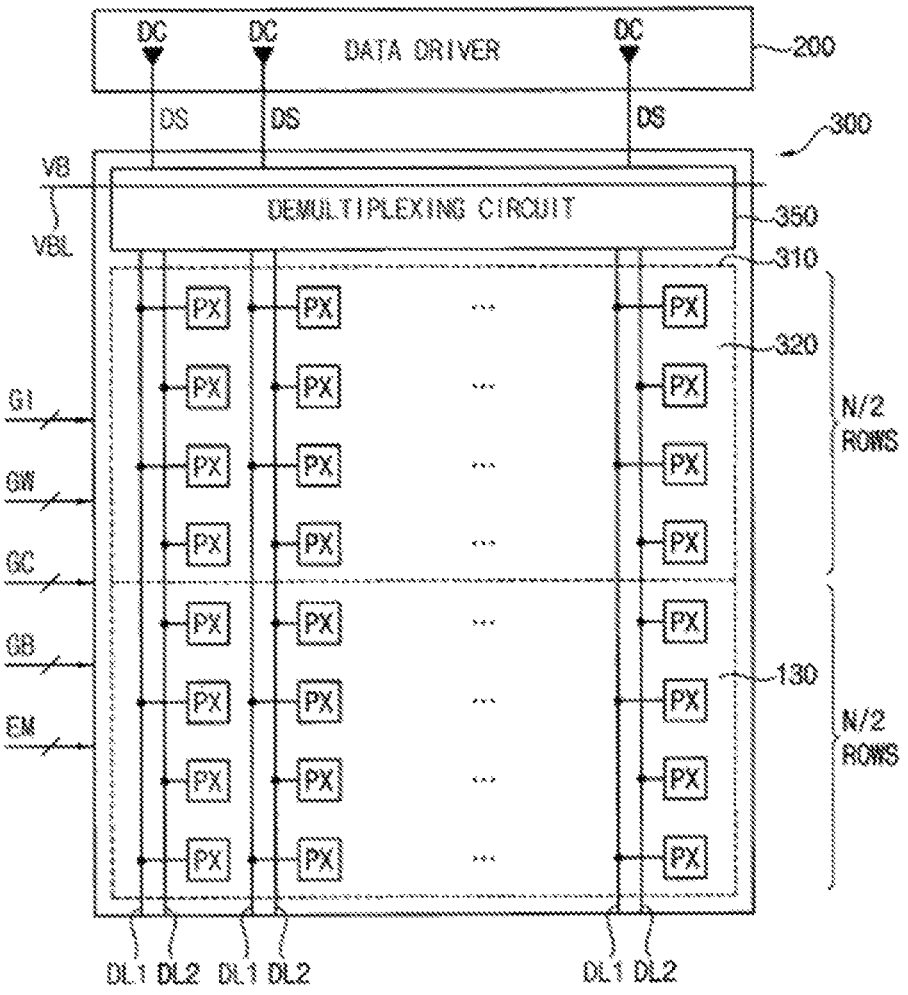
FIG. 11 is a diagram illustrating a display panel of an OLED display device according to exemplary embodiments.

FIG. 11 is a diagram illustrating a display panel of an OLED display device according to exemplary embodiments.

Referring to FIG. 11, a display panel 300 of an OLED display device according to exemplary embodiments may include a plurality of pixels PX located in N rows and M columns, M first data lines DL1 extending in a first direction, M second data lines DL2 extending in the first direction, and disposed alternately with the first data lines DL1 along a second direction crossing the first direction, and a demultiplexing circuit 350, where N is an integer greater than 1, and M is an integer greater than 1. The display panel 300 of FIG. 11 may have a similar configuration and a similar operation to a display panel 100 of FIG. 1, except that a connection relationship between the plurality of pixels PX and the first and second data lines DL1 and DL2. Although FIG. 11 illustrates an example of the display panel 300 including eight rows of the pixels PX for convenience of illustration, the number of pixel rows of the display panel 300 is not limited to eight.

The plurality of pixels PX in a K-th row of the N rows and the plurality of pixels PX in an (N/2+K)-th row of the N rows are coupled to different data lines from among the first data lines DL1 and the second data lines DL2, where K is an integer greater than 0 and less than N/2. In some exemplary embodiments, as illustrated in FIG. 11, among the plurality of pixels PX located in an upper half 320 of a display region 310, or among the plurality of pixels PX located in first through (N/2)-th rows, the plurality of pixels PX in odd-numbered rows may be coupled to the first data lines DL1, and the plurality of pixels PX in even-numbered rows may be coupled to the second data lines DL2. In contrast, among the plurality of pixels PX located in a lower half 330 of the display region 310, or among the plurality of pixels PX located in (N/2+1)-th through N-th rows, the plurality of pixels PX in odd-numbered rows may be coupled to the second data lines DL2, and the plurality of pixels PX in even-numbered rows may be coupled to the first data lines DL1. For example, as illustrated in FIG. 11, in the upper half 320 of the display region 310, the plurality of pixels PX in first and third rows may be coupled to the first data lines DL1, and the plurality of pixels PX in second and fourth rows may be coupled to the second data lines DL2. Further, in the lower half 330 of the display region 310, the plurality of pixels PX in fifth and seventh rows may be coupled to the second data lines DL2, and the plurality of pixels PX in sixth and eighth rows may be coupled to the first data lines DL1.

The demultiplexing circuit 350 may selectively couple a plurality of data channels DC of a data driver 200 to the first data lines DL1 or the second data lines DL2, and may couple data lines not coupled to the plurality of data channels DC from among the first data lines DL1 and the second data lines DL2 to a bias voltage line VBL. Accordingly, while the plurality of pixels PX in the K-th row perform a biasing operation and a data writing operation, the plurality of pixels PX in the (N/2+K)-th row may perform the biasing operation. Further, while the plurality of pixels PX in the (N/2+K)-th row perform the biasing operation and the data writing operation, the plurality of pixels PX in the K-th row may perform the biasing operation.

In an example illustrated in FIG. 11, while a gate initialization signal GI, a gate writing signal GW, a gate compensation signal GC, a gate bypass signal GB and an emission signal EM are applied to the first row of pixels PX, the first data lines DL1 coupled to the first row of pixels PX may be coupled to the plurality of data channels DC, and thus the first row of pixels PX may perform the biasing operation and the data writing operation. At substantially the same time, the gate writing signal GW, the gate bypass signal GB and the emission signal EM may be applied to the fifth row of pixels PX, the second data lines DL2 coupled to the fifth row of pixels PX may be coupled to the bias voltage line VBL, and thus the fifth row of pixels PX may perform the biasing operation. Thereafter, the second data lines DL2 coupled to the second row of pixels PX may be coupled to the plurality of data channels DC, and thus the second row of pixels PX may perform the biasing operation and the data writing operation. At substantially the same time, the first data lines DL1 coupled to the sixth row of pixels PX may be coupled to the bias voltage line VBL, and thus the sixth row of pixels PX may perform the biasing operation. In this manner, while the biasing operation and the data writing operation for the first through fourth rows of pixels PX are sequentially performed, the biasing operation for the fifth through eighth rows of pixels PX may be sequentially performed. Further, while the biasing operation and the data writing operation for the fifth through eighth rows of pixels PX are sequentially performed, the biasing operation for the first through fourth rows of pixels PX may be sequentially performed.

Accordingly, in the OLED display device including the display panel 300 according to exemplary embodiments, the biasing operation may be performed at a second frequency (e.g., about 240 Hz) higher than a first frequency (e.g., about 120 Hz) of the data writing operation. Thus, voltage-current characteristics of driving transistors of the respective pixels PX may be initialized at the higher frequency (e.g., about 240 Hz) by the biasing operation, and thus luminance uniformity of the display panel 300 may be improved without a ghost defect.

Figure 12:
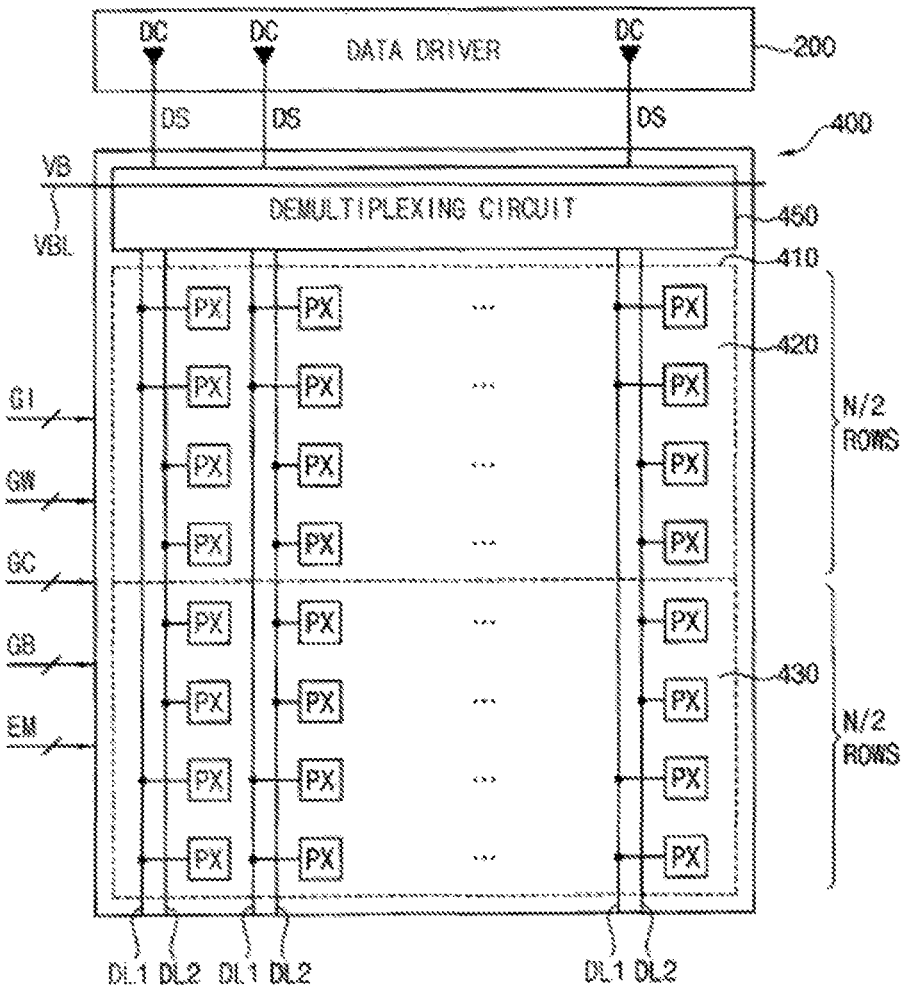
FIG. 12 is a diagram illustrating a display panel of an OLED display device according to exemplary embodiments.

FIG. 12 is a diagram illustrating a display panel of an OLED display device according to exemplary embodiments.

Referring to FIG. 12, a display panel 400 of an OLED display device according to exemplary embodiments may include a plurality of pixels PX located in N rows and M columns, M first data lines DL1 extending in a first direction, M second data lines DL2 extending in the first direction, and disposed alternately with the first data lines DL1 along a second direction crossing the first direction, and a demultiplexing circuit 450. The display panel 400 of FIG. 12 may have a similar configuration and a similar operation to a display panel 100 of FIG. 1 or a display panel 300 of FIG. 11, except that a connection relationship between the plurality of pixels PX and the first and second data lines DL1 and DL2. Although FIG. 12 illustrates an example of the display panel 400 including eight rows of the pixels PX for convenience of illustration, the number of pixel rows of the display panel 400 is not limited to eight.

The plurality of pixels PX in a K-th row of the N rows and the plurality of pixels PX in an (N/2+K)-th row of the N rows are coupled to different data lines from among the first data lines DL1 and the second data lines DL2. In some exemplary embodiments, as illustrated in FIG. 12, the plurality of pixels PX located in an upper half 420 of a display region 410, or the plurality of pixels PX located in first through (N/2)-th rows may be coupled to the first data lines DL1 or the second data lines DL2 alternately per L rows (e.g., two rows in an example of FIG. 12), where L is an integer greater than 1 and less than N/2. Further, the plurality of pixels PX located in a lower half 430 of the display region 410, or the plurality of pixels PX located in (N/2+1)-th through N-th rows may be coupled to the second data lines DL2 or the first data lines DL1 alternately per L rows. For example, as illustrated in FIG. 12, in the upper half 420 of the display region 410, the plurality of pixels PX in first and second rows may be coupled to the first data lines DL1, and the plurality of pixels PX in third and fourth rows may be coupled to the second data lines DL2. Further, in the lower half 430 of the display region 410, the plurality of pixels PX in fifth and sixth rows may be coupled to the second data lines DL2, and the plurality of pixels PX in seventh and eighth rows may be coupled to the first data lines DL1.

The demultiplexing circuit 450 may selectively couple a plurality of data channels DC of a data driver 200 to the first data lines DL1 or the second data lines DL2, and may couple data lines not coupled to the plurality of data channels DC from among the first data lines DL1 and the second data lines DL2 to a bias voltage line VBL. Accordingly, while the plurality of pixels PX in the K-th row perform a biasing operation and a data writing operation, the plurality of pixels PX in the (N/2+K)-th row may perform the biasing operation. Further, while the plurality of pixels PX in the (N/2+K)-th row perform the biasing operation and the data writing operation, the plurality of pixels PX in the K-th row may perform the biasing operation.

In an example illustrated in FIG. 12, the biasing operation and the data writing operation for the first and second rows of pixels PX may be performed by coupling the first data lines DL1 to the plurality of data channels DC, and, substantially simultaneously, the biasing operation for the fifth and sixth rows of pixels PX may be performed by coupling the second data lines DL2 to the bias voltage line VBL. Thereafter, the biasing operation and the data writing operation for the third and fourth rows of pixels PX may be performed by coupling the second data lines DL2 to the plurality of data channels DC, and, substantially simultaneously, the biasing operation for the seventh and eighth rows of pixels PX may be performed by coupling the first data lines DL1 to the bias voltage line VBL. Thereafter, the biasing operation and the data writing operation for the fifth and sixth rows of pixels PX may be performed by coupling the second data lines DL2 to the plurality of data channels DC, and, substantially simultaneously, the biasing operation for the first and second rows of pixels PX may be performed by coupling the first data lines DL1 to the bias voltage line VBL. Thereafter, the biasing operation and the data writing operation for the seventh and eighth rows of pixels PX may be performed by coupling the first data lines DL1 to the plurality of data channels DC, and, substantially simultaneously, the biasing operation for the third and fourth rows of pixels PX may be performed by coupling the second data lines DL2 to the bias voltage line VBL.

Accordingly, in the OLED display device including the display panel 400 according to exemplary embodiments, the biasing operation may be performed at a second frequency (e.g., about 240 Hz) higher than a first frequency (e.g., about 120 Hz) of the data writing operation. Thus, voltage-current characteristics of driving transistors of the respective pixels PX may be initialized at the higher frequency (e.g., about 240 Hz) by the biasing operation, and thus luminance uniformity of the display panel 400 may be improved without a ghost defect.

Figure 13:
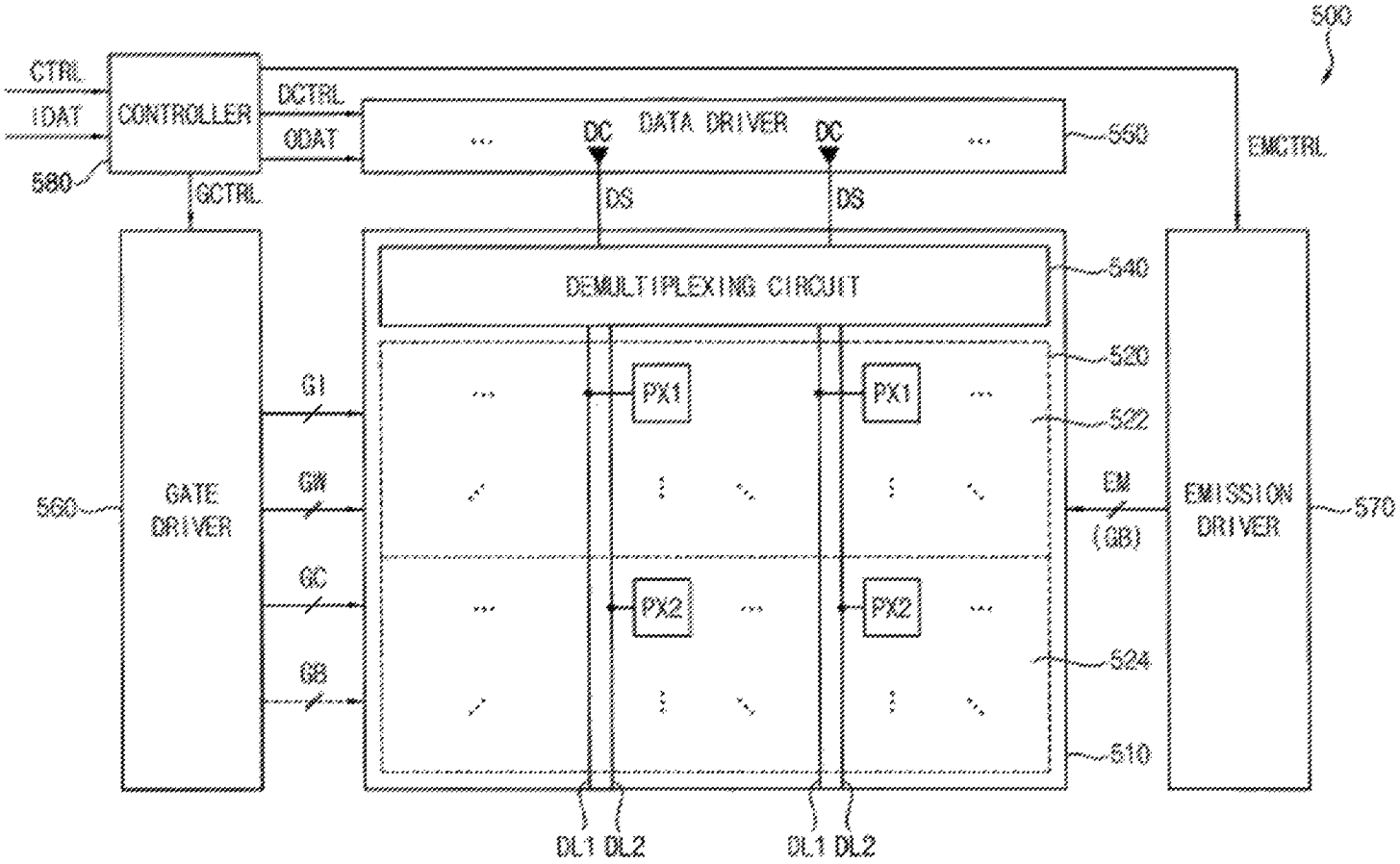
FIG. 13 is a block diagram illustrating an OLED display device according to exemplary embodiments.

FIG. 13 is a block diagram illustrating an OLED display device according to exemplary embodiments.

Referring to FIG. 13, an OLED display device 500 according to exemplary embodiments may include a display panel 510, a data driver 550, a gate driver 560, an emission driver 570 and a controller 580.

The display panel 510 may have a display region 520, may include a plurality of first pixels PX1 located at an upper half 522 of the display region 520, and a plurality of second pixels PX2 located at a lower half 524 of the display region 520. According to exemplary embodiments, the display panel 510 may be a display panel 100 of FIG. 1, a display panel 100*a* of FIG. 3, a display panel 100*b* of FIG.

7, a display panel 100*c* of FIG. 9, a display panel 300 of FIG. 11 or a display panel 400 of FIG. 12. The display panel 510 may further include a plurality of first data lines DL1 extending in a first direction (e.g., a vertical direction), and coupled to the plurality of first pixels PX1, a plurality of second data lines DL2 extending in the first direction, disposed alternately with the plurality of first data lines DL1 along a second direction (e.g., a horizontal direction) crossing the first direction, and coupled to the plurality of second pixels PX2, and a demultiplexing circuit 540 that selectively couples a plurality of data channels DC of the data driver 550 to the plurality of first data lines DL1 or the plurality of second data lines DL2. In some exemplary embodiments, the demultiplexing circuit 540 may receive upper and lower select signals from the controller 580, and may selectively couple the plurality of data channels DC to the plurality of first data lines DL1 or the plurality of second data lines DL2.

The data driver 550 may provide data signals DS to the plurality of first and second pixels PX1 and PX2 based on a data control signal DCTRL and output image data ODAT received from the controller 580. In some exemplary embodiments, the data control signal DCTRL may include, but not limited to, a horizontal start signal and a load signal. In some exemplary embodiments, the data driver 550 may include the plurality of data channels DC at which the data signals DS are output. Here, each data channel DC may mean components (e.g., an output buffer, a digital-to-analog converter, etc.) of the data driver 550 for outputting the corresponding data signal DS, a line through which the corresponding data signal DS is output, or a combination of the components and the line. Further, in some exemplary embodiments, the data driver 550 and the controller 580 may be implemented with a signal integrated circuit, and the signal integrated circuit may be referred to as a timing controller embedded data driver (TED). In other exemplary embodiments, the data driver 550 and the controller 580 may be implemented with separate integrated circuits.

The gate driver 560 may sequentially provide gate initialization signals GI, gate writing signals GW and gate compensation signals GC to the plurality of first and second pixels PX1 and PX2 on a row-by-row basis based on a gate control signal GCTRL received from the controller 580. In some exemplary embodiments, the gate driver 560 may further provide gate bypass signals GB to the plurality of first and second pixels PX1 and PX2. In some exemplary embodiments, the gate control signal GCTRL may include, but not limited to, a scan start signal and a gate clock signal. In some exemplary embodiments, the gate driver 560 may be integrated or formed in a peripheral portion of the display panel 510. In other exemplary embodiments, the gate driver 560 may be implemented with one or more integrated circuits.

The emission driver 570 may sequentially provide emission signals EM to the plurality of first and second pixels PX1 and PX2 on a row-by-row basis based on an emission control signal EMCTRL received from the controller 580. In some exemplary embodiments, the emission control signal EMCTRL may include, but not limited to, an emission start signal and an emission clock signal. In some exemplary embodiments, the emission signals EM may be used as the gate bypass signals GB. In some exemplary embodiments, the emission driver 570 may be integrated or formed in the peripheral portion of the display panel 510. In other exemplary embodiments, the emission driver 570 may be implemented with one or more integrated circuits.

The controller (e.g., a timing controller (TCON)) 580 may receive input image data DAT and a control signal CTRL from an external host (e.g., an application processor (AP), a graphic processing unit (GPU) or a graphic card). In some exemplary embodiments, the control signal CTRL may include, but not limited to, a vertical synchronization signal, a horizontal synchronization signal, a data enable signal, a master clock signal, etc. The controller 580 may control an operation of the data driver 550 by providing the output image data ODAT and the data control signal DCTRL to the data driver 550, may control an operation of the gate driver 560 by providing the gate control signal GCTRL to the gate driver 560, and may control an operation of the emission driver 570 by providing the emission control signal EMCTRL to the emission driver 570.

In the OLED display device 500 according to exemplary embodiments, the display panel 510 may include N rows of pixels PX1 and PX2, a biasing operation for an (N/2+K)-th row of pixels PX2 may be performed while the biasing operation and a data writing operation for a K-th row of pixels PX1 is performed, and the biasing operation for the K-th row of pixels PX1 may be performed while the biasing operation and the data writing operation for the (N/2+K)-th row of pixels PX2 are performed, where K is an integer greater than 0 and less than N/2. In some exemplary embodiments, in a first half of each frame period, while the first pixels PX1 located at the upper half 522 of the display region 520 perform the biasing operation and the data writing operation by using the plurality of first data lines DL1, the second pixels PX2 located at the lower half 524 of the display region 520 may perform the biasing operation by using the plurality of second data lines DL2. Further, in a second half of each frame period, while the second pixels PX2 located at the lower half 524 of the display region 520 perform the biasing operation and the data writing operation by using the plurality of second data lines DL2, the first pixels PX1 located at the upper half 522 of the display region 520 may perform the biasing operation by using the plurality of first data lines DL1. Accordingly, in the OLED display device 500 according to exemplary embodiments, the biasing operation may be performed at a second frequency higher than a first frequency of the data writing operation without the ghost defect.

Figure 14:
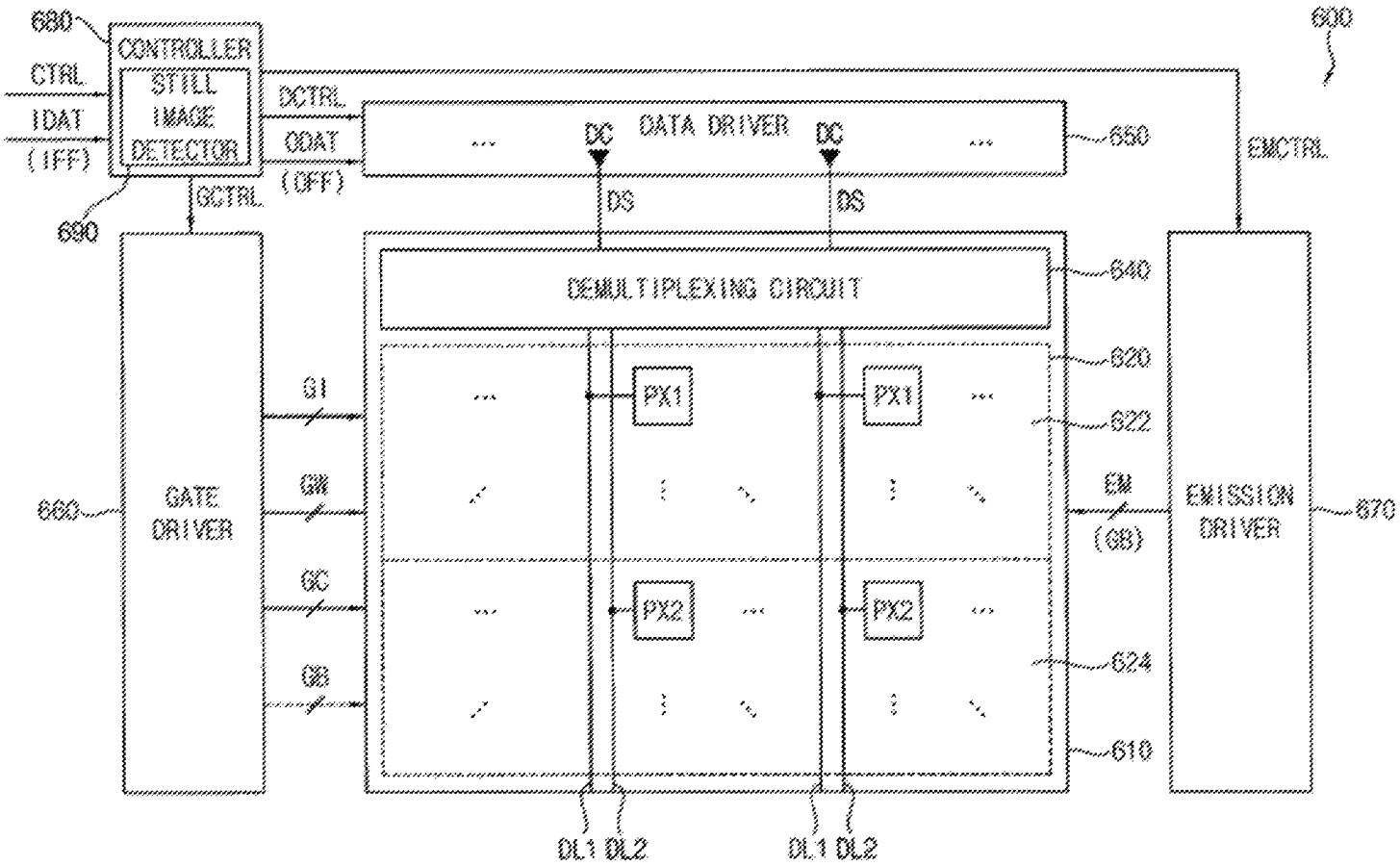
FIG. 14 is a block diagram illustrating an OLED display device according to exemplary embodiments.
Figure 15:
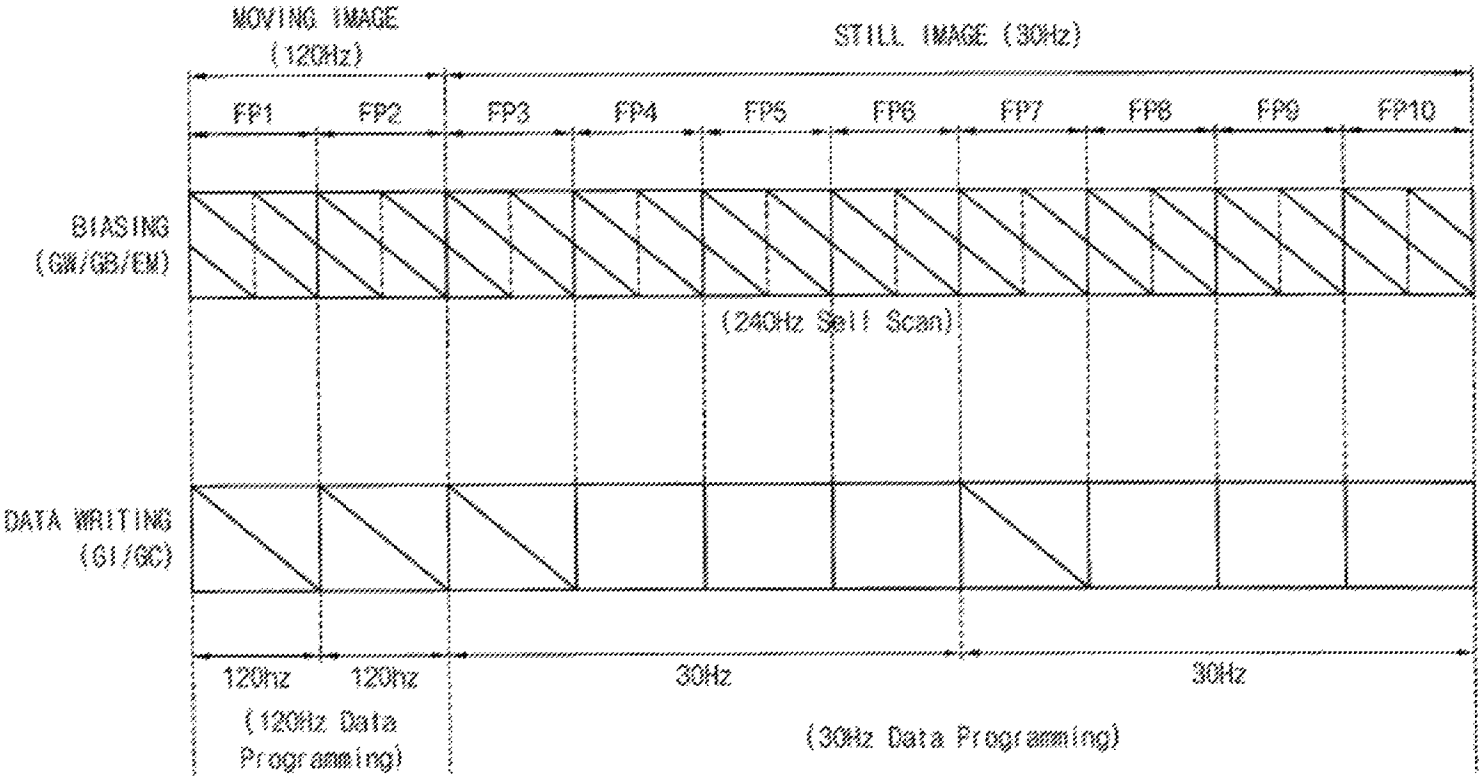
FIG. 15 is a timing diagram illustrating a biasing operation and a data writing operation of an OLED display device of FIG. 14.

FIG. 14 is a block diagram illustrating an OLED display device according to exemplary embodiments, and FIG. 15 is a timing diagram illustrating a biasing operation and a data writing operation of an OLED display device of FIG. 14.

Referring to FIG. 14, an OLED display device 600 according to exemplary embodiments may include a display panel 610, a data driver 650, a gate driver 660, an emission driver 670 and a controller 680. The display panel 610 may include a plurality of first pixels PX1 located at an upper half 622 of a display region 620, a plurality of second pixels PX2 located at a lower half 624 of the display region 620, a plurality of first data lines DL1 coupled to the plurality of first pixels PX1, a plurality of second data lines DL2 coupled to the plurality of second pixels PX2, and a demultiplexing circuit 640 that selectively couples a plurality of data channels DC to the plurality of first data lines DL1 or the plurality of second data lines DL2. The OLED display device 600 of FIG. 14 may have similar configuration and a similar operation to an OLED display device 500 of FIG. 13, except that the controller 680 may include a still image detector 690.

The controller 680 may include the still image detector 690 that determines whether input image data IDAT represents a still image. In some exemplary embodiments, the still image detector 690 may determine that the input image data IDAT represents the still image in a case where the input image data IDAT in a current frame period is substantially the same as the input image data IDAT in a previous frame period.

In a case where the input image data IDAT does not represent the still image, or in a case where the input image data IDAT represents a moving image, the controller 680 may decide a driving frequency for the display panel 610 as a first frequency. In some exemplary embodiments, the first frequency may be a normal driving frequency, or may be an input frame frequency IFF of the input image data IDAT received from an external host. For example, the first frequency may be, but not be limited to, about 120 Hz or about 60 Hz.

In a case where the input image data IDAT represents the still image, the controller 680 may decide the driving frequency for the display panel 610 as a third frequency lower than the first frequency. In some exemplary embodiments, the third frequency may be any frequency lower than the normal driving frequency of about 120 Hz or about 60 Hz. In some exemplary embodiments, the controller 680 may determine a flicker value of the still image according to luminance (or a gray level) of the still image, and may decide the third frequency according to the flicker value. When the driving frequency for the display panel 610 is decided as the third frequency, the controller 680 may provide output image data ODAT to the display panel 610 at the third frequency such that the display panel 610 is driven or refreshed at the third frequency lower than the first frequency. For example, the controller 680 may output the output image data ODAT at an output frame frequency OFF lower than the input frame frequency IFF, and the data driver 650 may drive the display panel 610 at the output frame frequency OFF lower than the input frame frequency IFF.

In some exemplary embodiments, in a case where the driving frequency for the display panel 610 is decided as the first frequency, the controller 680 may control the gate driver 660 such that a data writing operation for the display panel 610 may be performed at the first frequency, and a biasing operation for the display panel 610 may be performed at a second frequency (e.g., about 240 Hz) higher than the first frequency. Further, in a case where the driving frequency for the display panel 610 is decided as the third frequency, the controller 680 may control the gate driver 660 such that the data writing operation for the display panel 610 may be performed at the third frequency, and the biasing operation for the display panel 610 may be performed at the second frequency (e.g., about 240 Hz).

For example, as illustrated in FIG. 15, in first and second frame periods FP1 and FP2, in a case where the input image data IDAT does not represent the still image, or in a case where the input image data IDAT represents the moving image, the data writing operation for the display panel 610 may be performed at the first frequency of about 120 Hz, and the biasing operation for the display panel 610 may be performed at the second frequency of about 240 Hz. To perform these operations, the gate driver 660 may provide a gate initialization signal GI and a gate compensation signal GC to the plurality of first and second pixels PX1 and PX2 at the first frequency of about 120 Hz, and may provide a gate writing signal GW to the plurality of first and second pixels PX1 and PX2 at the second frequency of about 240 Hz. Further, in some exemplary embodiments, the emission driver 670 may provide an emission signal EM to the plurality of first and second pixels PX1 and PX2 at the second frequency of about 240 Hz, and the gate driver 660 or the emission driver 670 may provide a gate bypass signal GB to the plurality of first and second pixels PX1 and PX2 at the second frequency of about 240 Hz. Accordingly, in the first and second frame periods FP1 and FP2, a data programming operation may be performed at the first frequency of about 120 Hz, and a self scan operation may be performed at the second frequency of about 240 Hz.

Further, in third through tenth frame periods FP3 through FP10, in a case where the input image data IDAT represents the still image, the controller 680 may decide the driving frequency for the display panel 610 as the third frequency of about 30 Hz lower than the first frequency of about 120 Hz. In this case, the data writing operation for the display panel 610 may be performed at the third frequency of about 30 Hz, and the biasing operation for the display panel 610 may be performed at the second frequency of about 240 Hz. To perform these operations, the gate driver 660 may provide the gate initialization signal GI and the gate compensation signal GC to the plurality of first and second pixels PX1 and PX2 at the third frequency of about 30 Hz. For example, as illustrated in FIG. 15, to provide the gate initialization signal GI and the gate compensation signal GC at the third frequency of about 30 Hz, the gate driver 660 may provide the gate initialization signal GI and the gate compensation signal GC in only one FP3 of third through sixth frame periods FP3 through FP6 and in only one FP7 of seventh through tenth frame periods FP7 through FP10. The gate driver 660 may provide the gate writing signal GW to the plurality of first and second pixels PX1 and PX2 at the second frequency of about 240 Hz. Further, in some exemplary embodiments, the emission driver 670 may provide the emission signal EM to the plurality of first and second pixels PX1 and PX2 at the second frequency of about 240 Hz, and the gate driver 660 or the emission driver 670 may provide the gate bypass signal GB to the plurality of first and second pixels PX1 and PX2 at the second frequency of about 240 Hz. Accordingly, in the third through tenth frame periods FP3 through FP10, the data programming operation may be performed at the third frequency of about 30 Hz, and the self scan operation may be performed at the second frequency of about 240 Hz.

As described above, in the OLED display device 600 according to exemplary embodiments, even if low frequency driving that drives the display panel 610 at the output frame frequency OFF lower than the input frame frequency IFF is performed, the biasing operation or the self scan operation for the display panel 610 may be performed the second frequency (e.g., about 240 Hz) higher than the input frame frequency IFF. Accordingly, even if the low frequency driving is performed, luminance uniformity of the OLED display device 600 may be improved.

Figure 16:
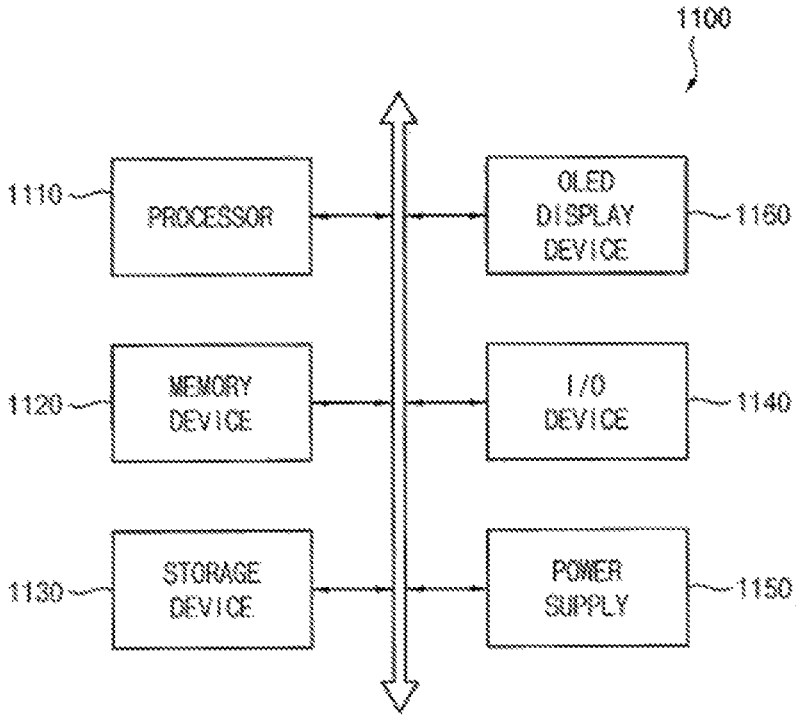
FIG. 16 is an electronic device including an OLED display device according to exemplary embodiments.

FIG. 16 is an electronic device including an OLED display device according to exemplary embodiments.

Referring to FIG. 16, an electronic device 1100 may include a processor 1110, a memory device 1120, a storage device 1130, an input/output (I/O) device 1140, a power supply 1150 and an OLED display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some exemplary embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The organic light emitting diode display device 1160 may be coupled to other components through the buses or other communication links.

In the OLED display device 1160, a plurality of first pixels may be located at an upper half of a display region, a plurality of second pixels may be located at a lower half of the display region, a plurality of first data lines may be coupled to the plurality of first pixels, a plurality of second data lines may be coupled to the plurality of second pixels, and a demultiplexing circuit may selectively couple a plurality of data channels to the plurality of first data lines or the plurality of second data lines. Thus, a biasing operation for the plurality of second pixels may be performed while the biasing operation and a data writing operation for the plurality of first pixels are performed, and the biasing operation for the plurality of first pixels may be performed while the biasing operation and the data writing operation for the plurality of second pixels are performed. Accordingly, in the OLED display device 1160, the biasing operation may be performed at a frequency higher than a frequency of the data writing operation without a ghost defect.

In other exemplary embodiments, in the OLED display device 1160, a K-th row of pixels and an (N/2+K)-th row of pixels may be coupled to different data lines from among first data lines and second data lines. A demultiplexing circuit may selectively couple a plurality of data channels to the first data lines or the second data lines, and may couple data lines not coupled to the plurality of data channels from among the first data lines and the second data lines to a bias voltage line. Thus, while the biasing operation for the (N/2+K)-th row of pixels may be performed while the biasing operation and the data writing operation for the K-th row of pixels are performed, and the biasing operation for the K-th row of pixels may be performed while the biasing operation and the data writing operation for the (N/2+K)-th row of pixels are performed.

The inventive concepts may be applied to any OLED display device 1160, and any electronic device 1100 including the OLED display device 1160. For example, the inventive concepts may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display panel of an organic light emitting diode (OLED) display device having a display region, the display panel comprising:

a plurality of first pixels located at an upper half of the display region;

a plurality of second pixels located at a lower half of the display region;

a plurality of first data lines extending in a first direction, coupled to the plurality of first pixels, and not coupled to the plurality of second pixels;

a plurality of second data lines extending in the first direction, disposed alternately with the plurality of first data lines along a second direction crossing the first direction, coupled to the plurality of second pixels, and not coupled to the plurality of first pixels; and a demultiplexing circuit configured to selectively couple a plurality of data channels of a data driver of the OLED display device to the plurality of first data lines or the plurality of second data lines, wherein:

a data writing operation for the display panel is configured to be performed at a first frequency;

a biasing operation for the display panel is configured to be performed at a second frequency higher than the first frequency;

a time length of a frame period is determined corresponding to the first frequency;

the data writing operation for the display panel is configured to be performed once per the frame period; and the biasing operation for the display panel is configured to be performed twice per the frame period.

2. The display panel of claim 1, wherein the demultiplexing circuit is configured to respectively couple the plurality of data channels to the plurality of first data lines during a first half of a frame period, and to respectively couple the plurality of data channels to the plurality of second data lines during a second half of the frame period.

3. The display panel of claim 2, wherein the demultiplexing circuit is configured to couple the plurality of second data lines to a bias voltage line during the first half of the frame period, and to couple the plurality of first data lines to the bias voltage line during the second half of the frame period.

4. The display panel of claim 3, wherein a bias voltage applied to the bias voltage line is configured to be higher than a highest data voltage.

5. The display panel of claim 3, wherein a bias voltage applied to the bias voltage line is configured to be changed in each frame period.

6. The display panel of claim 1, wherein the plurality of first pixels is located in N/2 rows from a first row to an (N/2)-th row, where N is an integer greater than 1, wherein the plurality of first pixels is located in N/2 rows from an (N/2+1)-th row to an N-th row, wherein, during a first half of a frame period, the biasing operation and the data writing operation for the plurality of first pixels are configured to be sequentially performed from the first row to the (N/2)-th row, and the biasing operation for the plurality of second pixels is configured to be sequentially performed from the (N/2+1)-th row to the N-th row, and wherein, during a second half of the frame period, the biasing operation for the plurality of first pixels is configured to be sequentially performed from the first row to the (N/2)-th row, and the biasing operation and the data writing operation for the plurality of second pixels are configured to be sequentially performed from the (N/2+1)-th row to the N-th row.

7. The display panel of claim 1, wherein the demultiplexing circuit includes:

a plurality of first switches configured to respectively couple the plurality of data channels to the plurality of first data lines in response to an upper select signal;

a plurality of second switches configured to respectively couple the plurality of data channels to the plurality of second data lines in response to a lower select signal;

a plurality of third switches configured to couple the plurality of first data lines to a bias voltage line in response to the lower select signal; and a plurality of fourth switches configured to couple the plurality of second data lines to the bias voltage line in response to the upper select signal.

8. The display panel of claim 7, wherein, during a first half of a frame period, the upper select signal is configured to have an on level, and the lower select signal is configured to have an off level, and wherein, during a second half of the frame period, the upper select signal is configured to have the off level, and the lower select signal is configured to have the on level.

9. The display panel of claim 1, wherein each of the plurality of first and second pixels includes:

a capacitor including a first electrode coupled to a line of a first power supply voltage, and a second electrode;

a first transistor including a gate electrode coupled to the second electrode of the capacitor;

a second transistor including a gate configured for receiving a gate writing signal, a first terminal coupled to a corresponding one of the plurality of first and second data lines, and a second terminal coupled to the first terminal of the first transistor;

a third transistor including a gate configured for receiving a gate compensation signal, a first terminal coupled to the second terminal of the first transistor, and a second terminal coupled to the gate of the first transistor;

a fourth transistor including a gate configured for receiving a gate initialization signal, a first terminal coupled to the second electrode of the capacitor and the gate of the first transistor, and a second terminal coupled to a line of a first initialization voltage;

a fifth transistor including a gate configured for receiving an emission signal, a first terminal coupled to the line of the first power supply voltage, and a second terminal coupled to the first terminal of the first transistor;

a sixth transistor including a gate configured for receiving the emission signal, a first terminal coupled to the second terminal of the first transistor, and a second terminal coupled to an anode of an organic light emitting diode;

a seventh transistor including a gate configured for receiving a gate bypass signal, a first terminal coupled to a line of a second initialization voltage, and a second terminal coupled to the anode of the organic light emitting diode; and the organic light emitting diode including the anode coupled to the second terminal of the sixth transistor, and a cathode coupled to a line of a second power supply voltage.

10. The display panel of claim 9, wherein a biasing operation and a data writing operation for each of the plurality of first and second pixels is configured to be performed in response to the gate initialization signal, the gate writing signal, the gate compensation signal, and the gate bypass signal while the emission signal has an off level, and wherein the biasing operation for each of the plurality of first and second pixels is configured to be performed in response to the gate writing signal and the gate bypass signal while the emission signal has the off level.

11. The display panel of claim 9, wherein the first, second, fifth, and sixth transistors are implemented with positive channel metal oxide semiconductor (PMOS) transistors, wherein the third, fourth, and seventh transistors are implemented with negative channel metal oxide semiconductor (NMOS) transistors, wherein the gate writing signal and the emission signal applied to the second, fifth, and sixth transistors are configured as active low signals that have a low level as an on level, wherein the gate compensation signal, the gate initialization signal, and the gate bypass signal applied to the third, fourth, and seventh transistors are configured as active high signals that have a high level as the on level, and wherein the emission signal is used as the gate bypass signal.

12. The display panel of claim 9, wherein the first, second, fifth, sixth and seventh transistors are implemented with positive channel metal oxide semiconductor (PMOS) transistors, wherein the third and fourth transistors are implemented with negative channel metal oxide semiconductor (NMOS) transistors, wherein the gate writing signal, the emission signal, and the gate bypass signal applied to the second, fifth, sixth and seventh transistors are configured as active low signals that have a low level as an on level, wherein the gate compensation signal and the gate initialization signal applied to the third and fourth transistors are configured as active high signals that have a high level as the on level, and wherein one of the gate writing signal for a previous row, the gate writing signal for a current row, and the gate writing signal for a next row is configured for use as the gate bypass signal for the current row.

13. An organic light emitting diode (OLED) display device comprising:

a display panel having a display region, and including a plurality of first pixels located at an upper half of the display region, and a plurality of second pixels located at a lower half of the display region;

a data driver including a plurality of data channels for outputting a data signal;

a gate driver configured to provide a gate initialization signal, a gate writing signal and a gate compensation signal to the plurality of first and second pixels; and a controller configured to control the data driver and the gate driver, wherein:

the display panel further includes:

a plurality of first data lines extending in a first direction, coupled to the plurality of first pixels, and not coupled to the plurality of second pixels;

a plurality of second data lines extending in the first direction, disposed alternately with the plurality of first data lines along a second direction crossing the first direction, coupled to the plurality of second pixels, and not coupled to the plurality of first pixels; and a demultiplexing circuit configured to selectively couple the plurality of data channels to the plurality of first data lines or the plurality of second data lines;

the controller includes a still image detector configured to determine whether input image data represents a still image;

the controller is configured to decide a driving frequency for the display panel as a first frequency when the input image data does not represent the still image, and to decide the driving frequency for the display panel as a third frequency lower than the first frequency when the input image data represents the still image; and when the input image data represents the still image, the gate driver is configured to provide the gate initialization signal and the gate compensation signal to the plurality of first and second pixels at the third frequency such that a data writing operation for the display panel is performed at the third frequency, and to provide the gate writing signal to the plurality of first and second pixels at a second frequency higher than the first frequency such that a biasing operation for the display panel is performed at the second frequency.

* * * * *